US010906347B2

(12) United States Patent
Itoi

(10) Patent No.: US 10,906,347 B2
(45) Date of Patent: Feb. 2, 2021

(54) PENCIL SHARPENER

(71) Applicant: OSAKA CLIP co., LTD, Osaka (JP)

(72) Inventor: Kazuo Itoi, Osaka (JP)

(73) Assignee: OSAKA CLIP co., LTD, Osaka (JP)

( * ) Notice: Subject to any disclaimer, the term of this patent is extended or adjusted under 35 U.S.C. 154(b) by 134 days.

(21) Appl. No.: 16/089,238

(22) PCT Filed: Jan. 31, 2017

(86) PCT No.: PCT/JP2017/003444
§ 371 (c)(1),
(2) Date: Sep. 27, 2018

(87) PCT Pub. No.: WO2017/169074
PCT Pub. Date: Oct. 5, 2017

(65) Prior Publication Data

US 2019/0126664 A1 May 2, 2019

(30) Foreign Application Priority Data

Mar. 30, 2016 (JP) ..... 2016-069831

(51) Int. Cl.
*B43L 23/04* (2006.01)
*B43L 23/00* (2006.01)
*B43L 23/08* (2006.01)

(52) U.S. Cl.
CPC ..... *B43L 23/04* (2013.01); *B43L 23/008* (2013.01); *B43L 23/08* (2013.01)

(58) Field of Classification Search
CPC ..... B43L 23/00; B43L 23/002; B43L 23/004; B43L 23/008; B43L 23/02; B43L 23/04; B43L 23/06; B43L 23/08; B43L 23/085
See application file for complete search history.

(56) References Cited

U.S. PATENT DOCUMENTS 4,741,105 A 5/1988 Wong
4,966,208 A * 10/1990 Uang ..... B43L 23/02 144/248.6

(Continued)

FOREIGN PATENT DOCUMENTS

CN 102963189 A 3/2013
CN 202806102 U 3/2013

(Continued)

OTHER PUBLICATIONS

International Search Report dated Mar. 7, 2017 filed in PCT/JP2017/003444.

(Continued)

*Primary Examiner* — Matthew Katcoff
(74) *Attorney, Agent, or Firm* — Rankin, Hill & Clark LLP

(57) ABSTRACT

The present invention provides a sharpening completion detection mechanism that does not apply a heavy load to a core tip, and especially proposes a mechanism that moves a pencil in an ejection direction immediately when the sharpening completion detection mechanism detects completion of sharpening to mitigate damage to the core. Specifically, a pencil sharpener according to the present invention includes: a slide unit that translates in pencil insertion and pencil ejection directions; a pencil biasing means supported by the slide unit; a slide locking means that locks a translation position of the slide unit upon the slide unit translating in the insertion direction; and a slide unit unlocking means that releases the lock for the translation position of the slide unit upon the sharpening completion detection means detecting a fully sharpened state of the pencil, and includes slide unit ejecting means that biases the slide unit in the ejection direction with energy stored by movement of the slide unit to a lock position.

12 Claims, 19 Drawing Sheets

(56) References Cited

U.S. PATENT DOCUMENTS

| | | | | |
|---|---|---|---|---|
| 7,240,703 | B2 * | 7/2007 | Hu | B43L 23/002 144/28.5 |
| 8,459,317 | B2 * | 6/2013 | Hu | B43L 23/002 144/28.1 |
| 2006/0272743 | A1 | 12/2006 | Hu | |

FOREIGN PATENT DOCUMENTS

| | | | |
|---|---|---|---|
| CN | 103786505 | A | 5/2014 |
| CN | 203780165 | U | 8/2014 |
| JP | 40-32326 | | 11/1965 |
| JP | 45-4269 | | 2/1970 |
| JP | 49-17211 | | 4/1974 |
| JP | 49-19650 | | 5/1974 |
| JP | 50-7974 | | 3/1975 |
| JP | 52-3647 | | 1/1977 |
| JP | 1-317795 | A | 12/1989 |

OTHER PUBLICATIONS

Notification of Reasons for Refusal dated Oct. 7, 2016 for the corresponding Japanese Patent Application No. 2016-069831 and its English machine translation.

Office Action dated Oct. 30, 2019 for the corresponding Chinese Patent Application No. 201780020498.X.

Japanese Office Action (JPOA) dated Oct. 7, 2016 issued in the corresponding Japanese Patent Application No. 2016-069831 and its English machine translation.

* cited by examiner (a)

(b)

(a)

(b)

(a)

(b)

(a)

(b)

(a)

(b)

(a)

(b)

(a)

(b)

PENCIL SHARPENER

TECHNICAL FIELD

The present invention relates to a pencil sharpener.

BACKGROUND ART

Recent years' pencil sharpeners are provided with a mechanism for preventing sharpening too much. In other words, a mechanism is provided which, for example, stops shaving when the core tip has been shaved to a desired thickness, and notifies a user of completion of the shaving.

For example, in a pencil sharpener having a feed roller that rotates in conjunction with the rotation of a crank to feed a pencil into a cutter frame, a stopper is provided in a predetermined position of the cutter frame. The pencil sharpener is configured in such a manner that when the core tip comes into contact with the stopper, the feed roller moves in a direction away from the core tip due to a reaction force to the contact, and is disengaged from a gear that synchronizes the rotation of the crank with the rotation of the feed roller to stop the rotation of the feed roller.

However, there is also a problem with color pencils and 2B and 3B pencils, which have soft cores, that when the core tip comes into contact with the stopper, the core tip is worn and accordingly, the gear that forces synchronization with the rotation of the feed roller is not disengaged, and the shaving continues; therefore, the shaving does not stop.

In order to prevent such a problem, it is necessary to minimize the force of the feed roller to feed a pencil into the cutter frame. However, if the feeding force is reduced too much, a pencil may not be able to be fed in, or even if a pencil can be fed in, the shaving may not be able to be performed efficiently due to the small feeding force. The adjustment of the feed roller is very difficult.

As one means for solving such problems, a mechanism has been proposed in which energy is stored in an energy storing member by a shaving rotational force and, when a core tip presses a stopper, the stopper moves to the rear, and accordingly a gear engaged with the energy storing member is disengaged and then engaged with a gear of the feed roller, the energy stored in the energy storing member is released, and the energy allows the feed roller to rotate backward to release the pencil (for example, Patent Literature 1).

CITATION LIST

Patent Literature

Patent Literature 1: JP-B-49-17211

DISCLOSURE OF THE INVENTION

Problems to be Solved by the Invention

However, since the force of the core tip to press the stopper switches the gears in the mechanism disclosed in Patent Literature 1, it is necessary for the core tip to continue pressing the stopper strongly. In a case of a pencil with a soft core, there is a problem that when the core tip presses the stopper strongly, the core tip is worn; accordingly, the stopper cannot be moved a predetermined stroke, which results in continuing the shaving. Even in a case of a pencil with a hard core, there is a problem that the core tip is damaged. Therefore, the commercialization is very difficult. Moreover, a complicated component such as the energy storing member is required; accordingly, there is also a problem that the manufacturing cost is very high. Furthermore, if the energy storing member is, for example, a spring, the elastic force deteriorates successively. Accordingly, there is also another problem that long-term reliability cannot be ensured.

The present invention has been made to solve such problems, and provides a mechanism that detects a fully sharpened state without applying a heavy load to a core tip. Specifically, when completion of sharpening is detected, not the force of the core tip to press a stopper, but the torque that rotates a crank is used as energy to drive a shaving stop mechanism or a shaving completion notification mechanism to a user.

Moreover, the present invention proposes a mechanism that moves a pencil immediately in an ejection direction when the mechanism that detects the fully sharpened state detects the completion of the sharpening to further mitigate the damage of the core. The present invention stores the force of inserting a pencil into a pencil sharpener in an elastic means to enable the movement of the pencil in the ejection direction with the simple mechanism that can easily become commercially practical.

Furthermore, an ejection mechanism is proposed which ejects a pencil by rotating a crank forward without rotating the crank backward and without requiring a complicated member such as an energy storing member.

Solutions to the Problems

A pencil sharpener according to the present invention is a pencil sharpener that includes: a casing; a torque generation means that generates rotational torque by manual rotation of a crank or an electric motor; an insertion unit into which a pencil is insertable; a cutter frame that has a cutter to shave the inserted pencil and is rotated by torque generated by the torque generation means; a pencil biasing means that converts the rotation of the cutter frame into motion of biasing the pencil in an insertion direction and biases the pencil in the insertion direction; and a sharpening completion detection means that detects a fully sharpened state of the pencil. The pencil biasing means is capable of translating in the pencil insertion direction and a pencil ejection direction, stores energy generated by moving the pencil biasing means in the pencil insertion direction upon the pencil being inserted, releases the energy in conjunction with the sharpening completion detection means, and accordingly moves the pencil in the pencil ejection direction.

Moreover, the pencil sharpener according to the present invention further includes: a slide unit that is supported by the casing and translates in the pencil insertion and pencil ejection directions; a slide unit locking means that locks a translation position of the slide unit upon the slide unit translating in the pencil insertion direction; and a slide unit unlocking means that releases the lock for the translation of the slide unit with the slide unit locking means upon the sharpening completion detection means detecting the fully sharpened state of the pencil. The slide unit has a slide unit ejecting means that biases the slide unit in the ejection direction with energy stored by movement of the slide unit to a lock position, and the pencil biasing means is supported by the slide unit.

Furthermore, a pencil sharpener according to the present invention is a pencil sharpener including: a torque generation means that generates rotational torque by manual rotation of a crank or an electric motor; an insertion unit into which a pencil is insertable; a cutter frame that has a cutter to shave the inserted pencil and is rotated by torque generated by the torque generation means; a pencil biasing means that biases the pencil in an insertion direction; and a shaving stop means that stops shaving the pencil in accordance with a fully sharpened state of the pencil, and/or a shaving completion notification means. The cutter frame is provided with a core tip detection unit for detecting a tip position of the pencil, the core tip detection unit rotates in conjunction with the cutter frame, and is supported in such a manner as to be capable of translating or changing an angle with respect to the cutter frame, a detection unit biasing means that biases the core tip detection unit in a pencil ejection direction is provided between the core tip detection unit and the cutter frame, a detection portion being a portion of the core tip detection unit is in a position that comes into contact with the core tip of the pencil, the core tip of the pencil presses the detection portion of the core tip detection unit to cause the core tip detection unit to translate or change an angle with respect to the cutter frame, the translation or angle change allows a path of rotation of a transmission portion being a portion of the core tip detection unit to change, and rotational torque of the rotating transmission portion transmits that the pencil has entered a predetermined fully sharpened state to the shaving stop means and/or the shaving completion notification means.

Moreover, a pencil sharpener according to the present invention includes: a casing; a torque generation means that generates rotational torque by manual rotation of a crank or an electric motor; an insertion unit into which a pencil is insertable; a cutter frame that has a cutter to shave the inserted pencil and is rotated by torque generated by the torque generation means; a pencil biasing means that converts the rotation of the cutter frame into motion of biasing the pencil in an insertion direction or an ejection direction; a sharpening completion detection means that detects a fully sharpened state of the pencil; and a means that stores energy generated upon the pencil being inserted. Insertion pressure upon the pencil being inserted switches the pencil biasing means to convert the rotation of the cutter frame into the motion of biasing the pencil in the insertion direction, and also switches the pencil basing means to store energy in the means that stores energy, release the energy in conjunction with the sharpening completion detection means, and accordingly convert the rotation of the cutter frame into the motion of biasing the pencil in the ejection direction.

Effects of the Invention

The pencil sharpener according to the present invention is configured as described above and accordingly has many effects of the invention illustrated below.

Firstly, when the pencil is fully sharpened, the detection of the completion of the sharpening is ensured to enable prevention of unnecessary sharpening of the pencil. Especially, it is possible to reliably stop shaving even a pencil with a soft core such as a colored pencil. In a case of a known pencil sharpener, it is necessary to perceive the completion of shaving of a pencil with a soft core by a sense, and it is difficult to prevent unnecessary sharpening.

Moreover, the shaving stop means is not driven by the pressure of the core tip. However, the shaving stop means can be driven by large rotational torque generated by a torque generation means 1. Accordingly, a complicated mechanism can be driven. Therefore, the core tip is not damaged. The core tip simply presses a detection portion 6*b* against a small force of biasing the detection portion 6*b*. Accordingly, a reaction force applied to the core tip is small. Even in a case of a pencil with a soft core, the core tip is not worn, or the tip is not broken.

It is difficult in pencil sharpeners that are currently in wide use to appropriately set the force of a feed roller to insert a pencil into a cutter frame. If the insertion force is too large, when the tip of the pencil comes into contact with a stopper, the shaving does not stop. Conversely, if the insertion force is too small, the shaving cannot be performed. Moreover, pencils have different shapes such as hexagons and cylindrical shapes, and are also subtly different in diameter according to the manufactures and the like. Accordingly, the setting of the insertion force is more difficult. In the present invention, a pencil escapes from a shaving unit. Accordingly, there is no risk of sharpening too much even if the insertion force of the feed roller is set to be sufficiently large. The setting of the insertion force is facilitated very much, and the finished quality of sharpening can be improved.

Moreover, the torque generation means 1 can perform operations automatically from shaving to pencil ejection by generating rotational torque in the same direction. In a hand crank pencil sharpener, it is almost impossible to reverse the direction of rotation in the middle. Moreover, in a case of an electric pencil sharpener, it is possible to reverse the direction of rotation of the motor, triggered by a signal for completion of sharpening. However, the mechanism is complicated, and there arise problems in cost and the like. In the present invention, for example, also a hand crank pencil sharpener can perform operations automatically from shaving to pencil ejection during rotation in the same direction, which is a very excellent feature. Workability is significantly improved. In addition, a feeling of comfort can also be given to a user.

DESCRIPTION OF THE PREFERRED EMBODIMENTS

First Embodiment

An embodiment of a pencil sharpener according to the present invention is described hereinafter, using the drawings. The following embodiment is an optimal example of the present invention, and the present invention is not especially limited to this example.

<Configuration of Pencil Sharpener>

Figure 1:
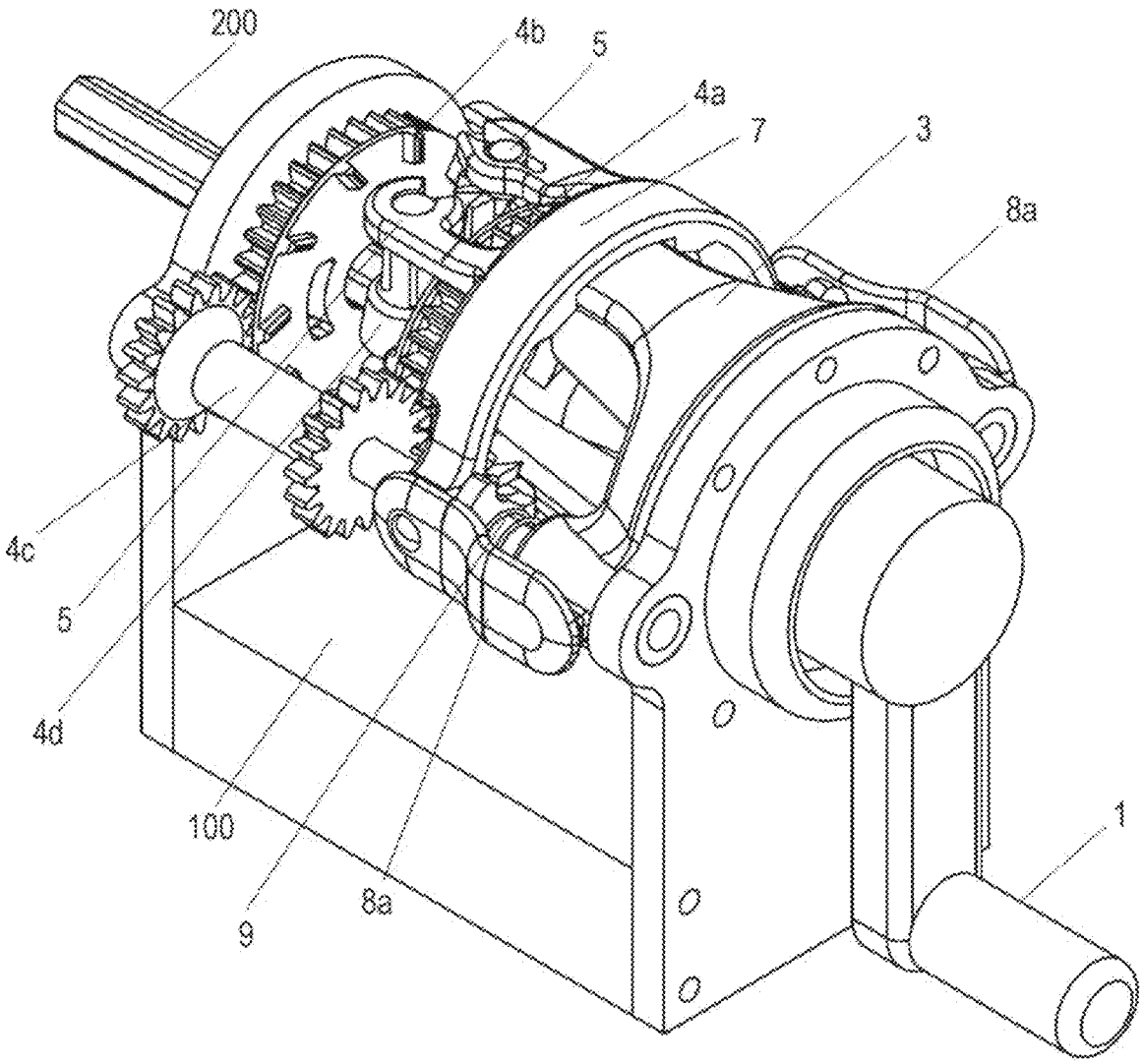
FIG. 1 is a general view of the inside of a pencil sharpener of the present invention.
Figure 2:
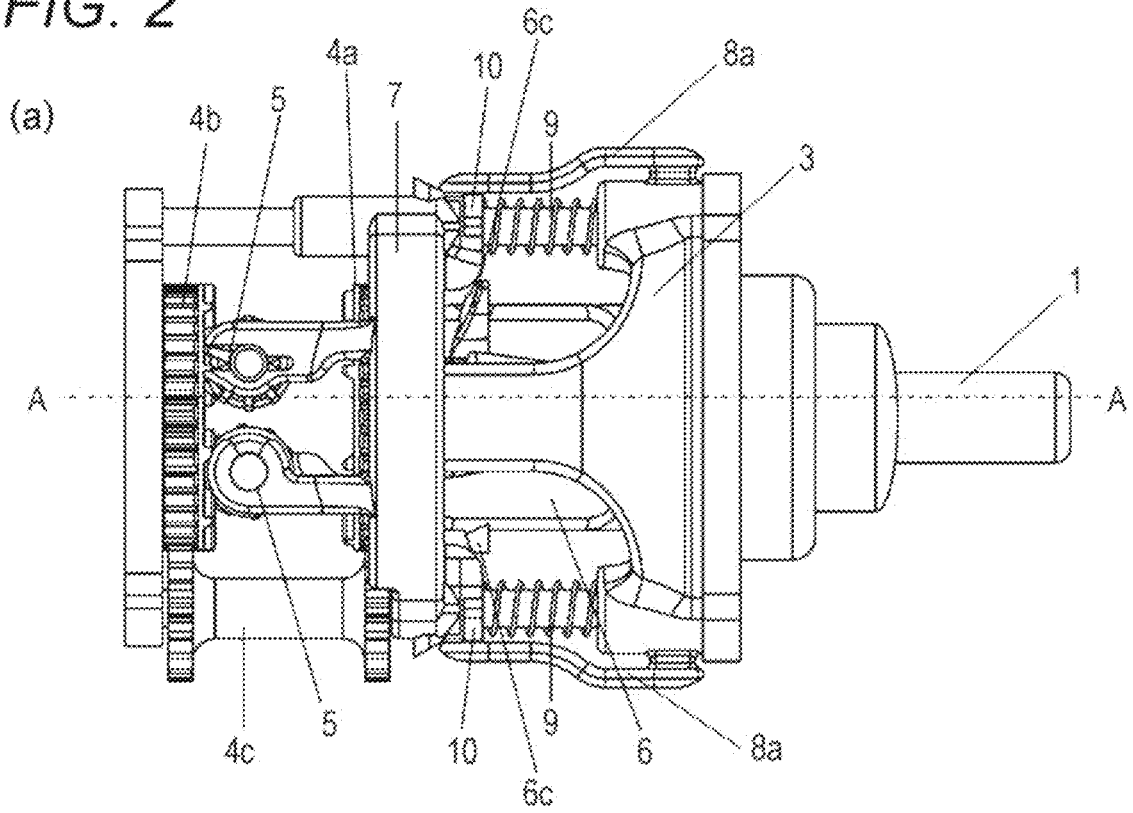
FIGS. 2(*a*) and 2(*b*) are an internal top view and an internal side view of the pencil sharpener of the present invention in a state where a pencil is not inserted.
Figure 2:
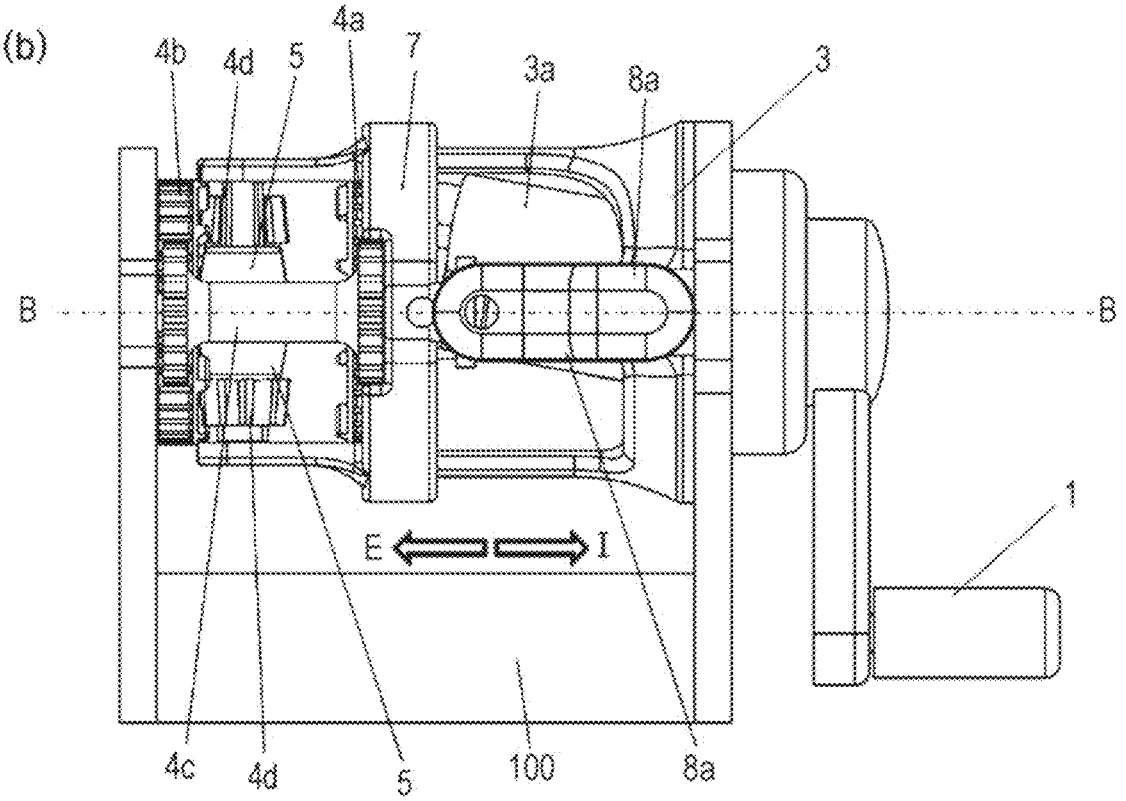
Figure 3:
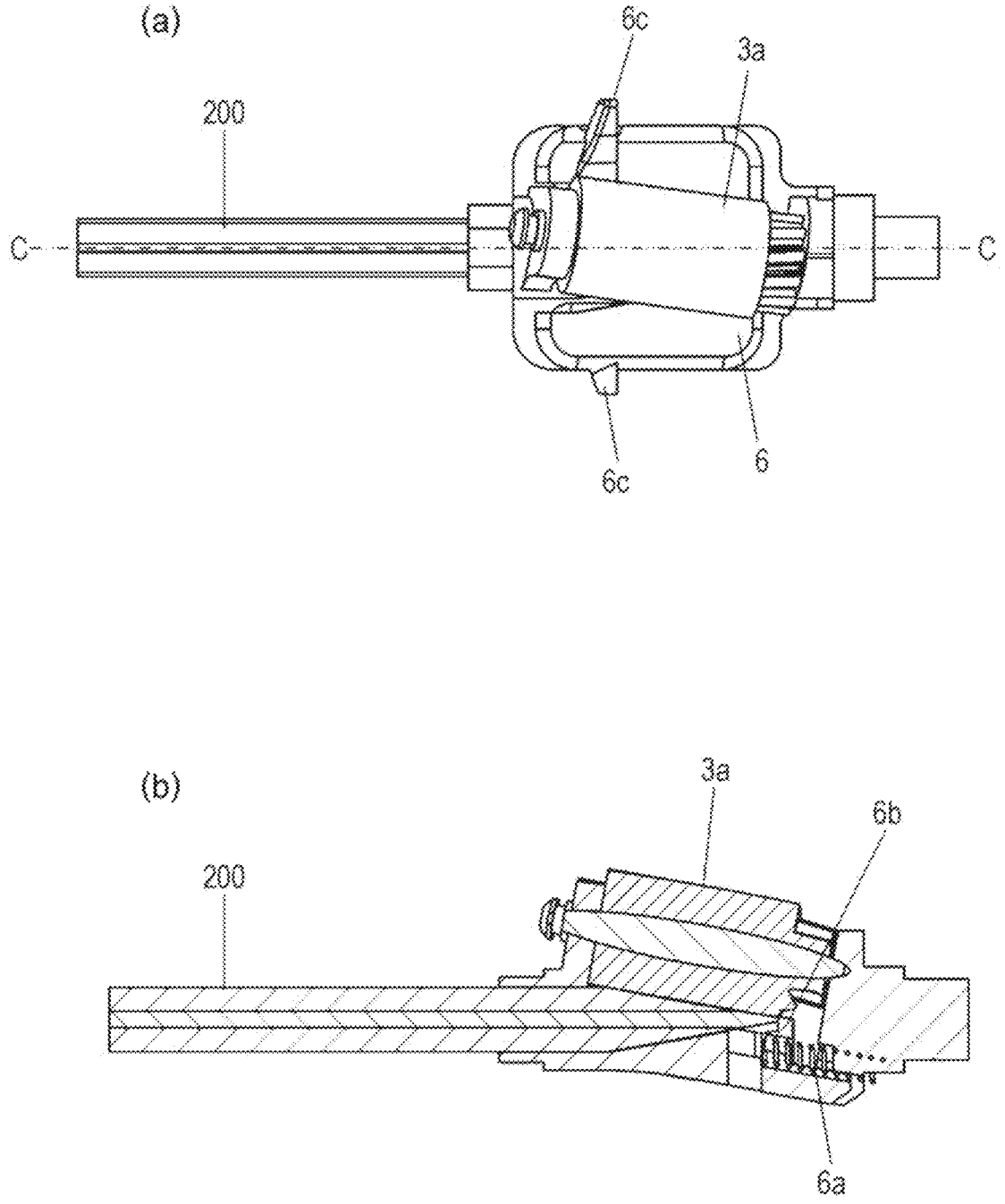
FIGS. 3(*a*) and 3(*b*) are part drawings of a cutter frame and a core tip detection unit of the pencil sharpener of the present invention, and are a top view and a C-C cross-sectional view.

Firstly, a main configuration of the pencil sharpener is described, using FIGS. 1 to 3(*b*).

FIG. 1 is a general view of the inside of the pencil sharpener, and is a perspective view in a state where a casing has been removed.

FIGS. 2(*a*) and 2(*b*) are an internal top view and an internal side view of the pencil sharpener in a state where a pencil is not inserted.

Moreover, FIGS. 3(*a*) and 3(*b*) are part drawings of a cutter frame and a core tip detection unit of the pencil sharpener, and are a top view and a C-C cross-sectional view.

The pencil sharpener is a pencil sharpener including, in addition to the casing, a torque generation means 1 that generates rotational torque by manual rotation of a crank or an electric motor; an insertion unit into which a pencil 200 is insertable; a cutter frame 3 that has a cutter 3*a* to shave the inserted pencil 200 and is rotated by torque generated by the torque generation means 1; a rotation axis conversion means that converts an axis of rotation of the cutter frame 3 into an axis of rotation perpendicular to the axis of rotation of the cutter frame 3; a feed roller 5 that is rotated by the rotation axis conversion means and biases the pencil in an insertion direction; and a shaving stop means that stops shaving the pencil in accordance with a fully sharpened state of the pencil, and/or a shaving completion notification means. The cutter frame 3 is provided with a core tip detection unit 6 for detecting a tip position of the pencil. The core tip detection unit 6 rotates in conjunction with the cutter frame 3, and is supported in such a manner as to be capable of translating or changing an angle with respect to the cutter frame 3. A detection unit elastic means 6*a* being a detection unit biasing means that biases the core tip detection unit 6 in a pencil ejection direction is provided between the core tip detection unit 6 and the cutter frame 3. A detection portion 6*b* being a portion of the core tip detection unit 6 is in a position that comes into contact with the core tip of the pencil 200. The core tip of the pencil 200 presses the detection portion 6*b* of the core tip detection unit 6, and accordingly the core tip detection unit 6 translates or changes the angle with respect to the cutter frame 3. Consequently, a rotation path of a transmission portion 6*c* being a portion of the core tip detection unit 6 changes. Rotational torque of the rotating transmission portion 6*c* transmits that the pencil 200 has entered a predetermined fully sharpened state to the shaving stop means and/or the shaving completion notification means.

The rotation axis conversion means and the feed roller 5 configure a pencil biasing means that biases the pencil in the insertion direction, or the ejection direction if necessary.

In the embodiment, along an axis for inserting the pencil, leftward (a direction of an open arrow E in FIG. 2(*b*)) is referred to as the pencil ejection direction, and rightward (a direction of an open arrow I in FIG. 2(*b*)) as the pencil insertion direction.

As described above, the torque generation means 1 generates rotational torque by manual rotation of a crank, or an electric motor. In other words, the pencil sharpener of the present invention may be manual or electric.

A reference sign 100 is a shavings storage space for storing shavings.

The cutter frame 3 includes the cutter 3*a* that shaves the pencil 200 by planetary rotation or the like. As illustrated in FIGS. 3(*a*) and 3(*b*), the core tip detection unit 6 being a sharpening completion detection means that detects completion of sharpening of the pencil 200 is provided below the cutter 3*a*. The core tip detection unit 6 is provided in such a manner as to be capable of translating or changing the angle with respect to the cutter frame 3. Moreover, the detection unit elastic means 6*a* such as a spring is provided between the core tip detection unit 6 and the cutter frame 3, and biases the core tip detection unit 6 in the pencil ejection direction. The biasing force is a sufficiently small force at a degree that allows the core tip detection unit 6 to return to a reference position when the core tip detection unit 6 is not in contact with the core tip of the pencil.

Moreover, the detection portion 6*b* being a portion of the core tip detection unit 6 is provided near the core tip of the pencil 200, and is in a position that is pressed in the insertion direction in contact with the core tip until the shaving progresses and the core tip enters a predetermined fully sharpened state.

Furthermore, the transmission portion 6*c* being a portion of the core tip detection unit 6 is provided at, for example, each of two points in positions protruding to the left and right when viewed from the top surface.

Figure 4:
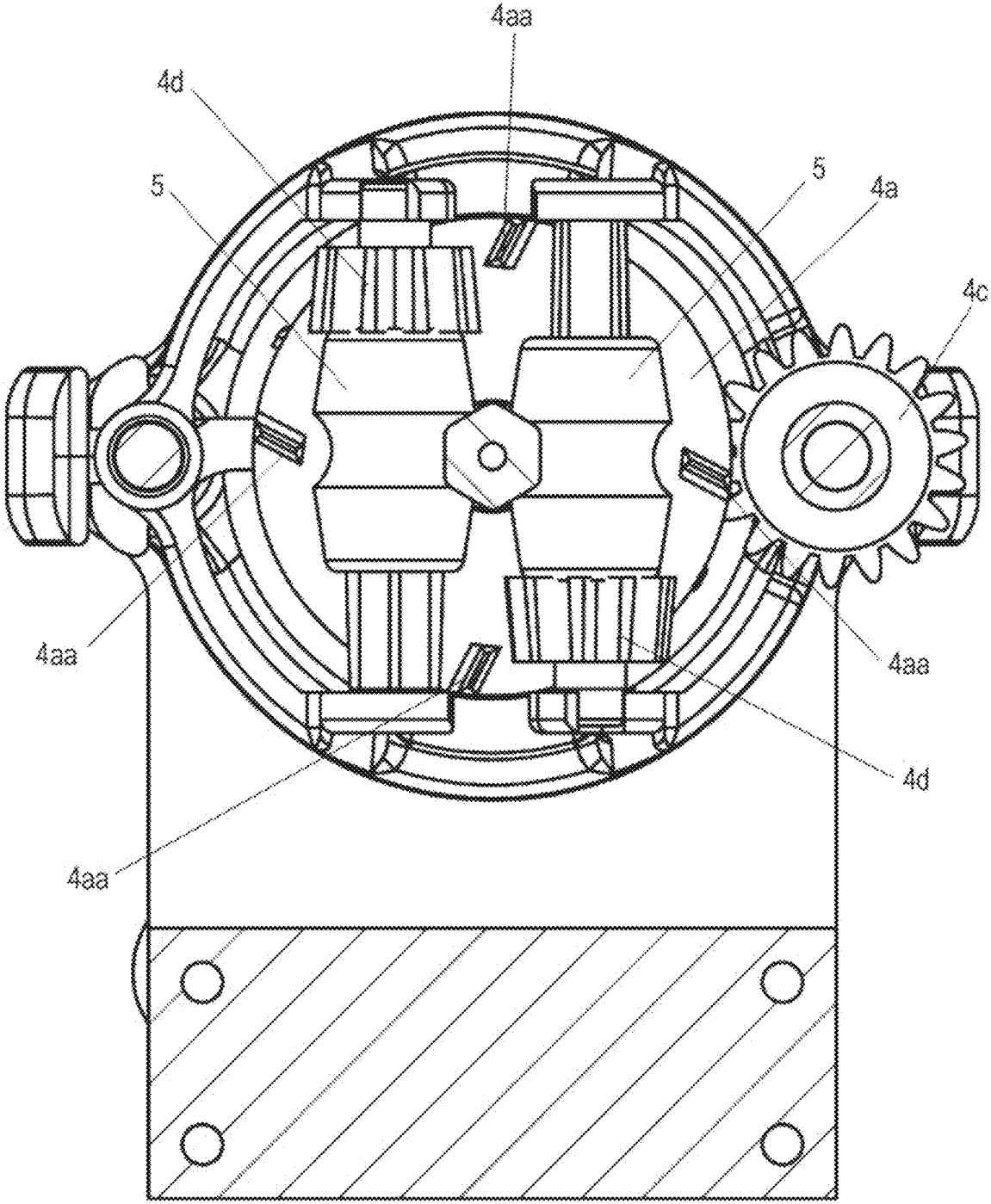
FIG. 4 is a schematic diagram for explaining a rotation mechanism of a feed roller of the pencil sharpener of the present invention.
Figure 5:
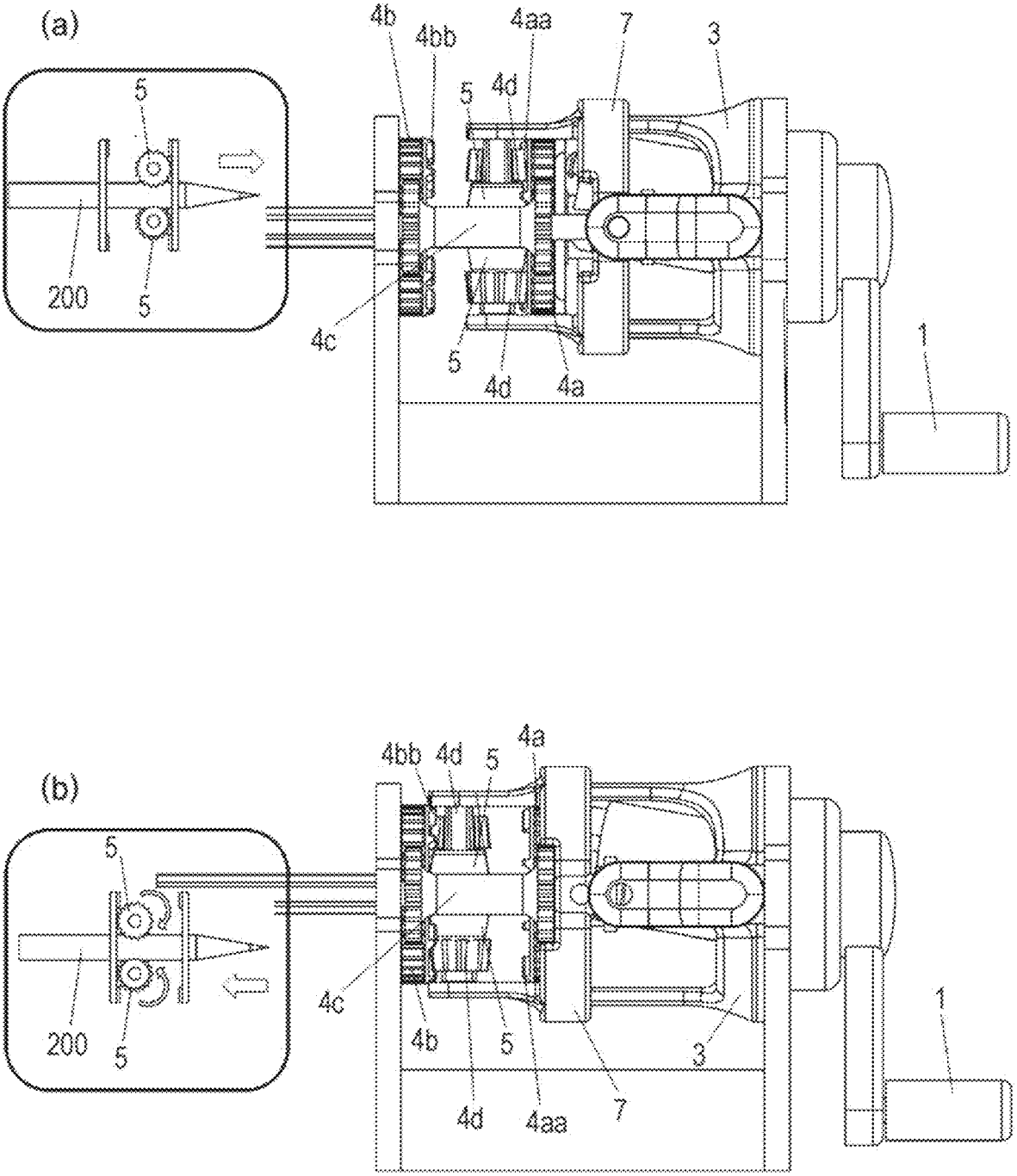
FIGS. 5(*a*) and 5(*b*) are schematic diagrams for explaining the operation of the feed roller of the pencil sharpener of the present invention upon shaving and upon ejection.

As illustrated in FIGS. 4 and 5(*a*) and 5(*b*), the rotation axis conversion means is a means including, for example, a plurality of gears to convert the rotation direction of the cutter frame 3 into rotation of which axis of rotation is in a perpendicular direction. In the embodiment, it is configured of a combination of components such as coaxial gears 4*a* and 4*b*, a transmission gear 4*c*, and roller-specific gears 4*d*.

The feed roller 5 is rotated by the rotation axis conversion means and biases the pencil in the insertion direction or the ejection direction. The feed roller 5 includes a pair of feed rollers, and the feed rollers use, for example, the deformation of resin supporting the feed rollers to be biased weakly in such a manner as to move closer to each other.

The shaving stop means is a means that operates when the core tip detection unit 6 being the sharpening completion detection means that detects completion of sharpening of a pencil detects completion of sharpening of the pencil, and stops shaving the pencil. For example, in a case of an electric pencil sharpener, the means may stop or rotate backward the motor being the torque generation means 1, or may be means that ejects a pencil from the cutter 3*a* as described in the embodiment.

The shaving completion notification means is a notification means that notifies a user of completion of shaving of a pencil with a warning sound or a display on a liquid crystal. In a case of a manual pencil sharpener, a user who has recognized that the pencil has fully been sharpened by the shaving completion notification means stops rotating the crank to enable prevention of unnecessary shaving.

Figure 6:
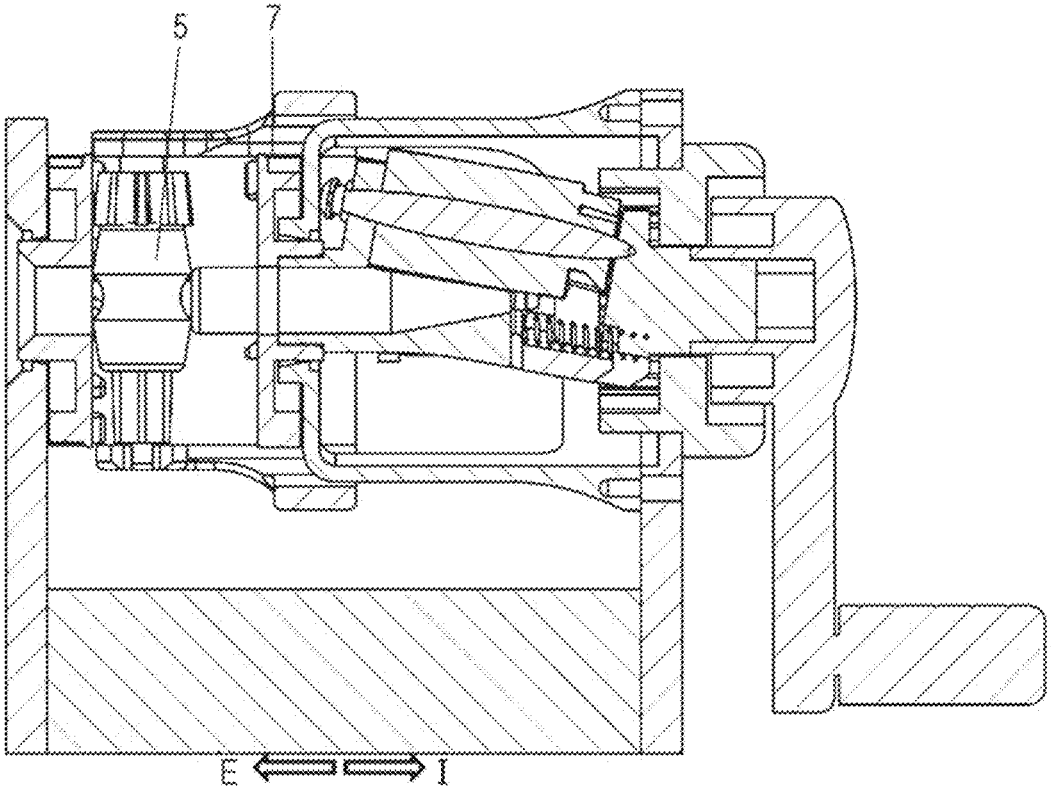
FIGS. 6(*a*) and 6(*b*) are an A-A side view and a B-B cross-sectional view of the pencil sharpener of the present invention in the state where the pencil is not inserted.
Figure 6:
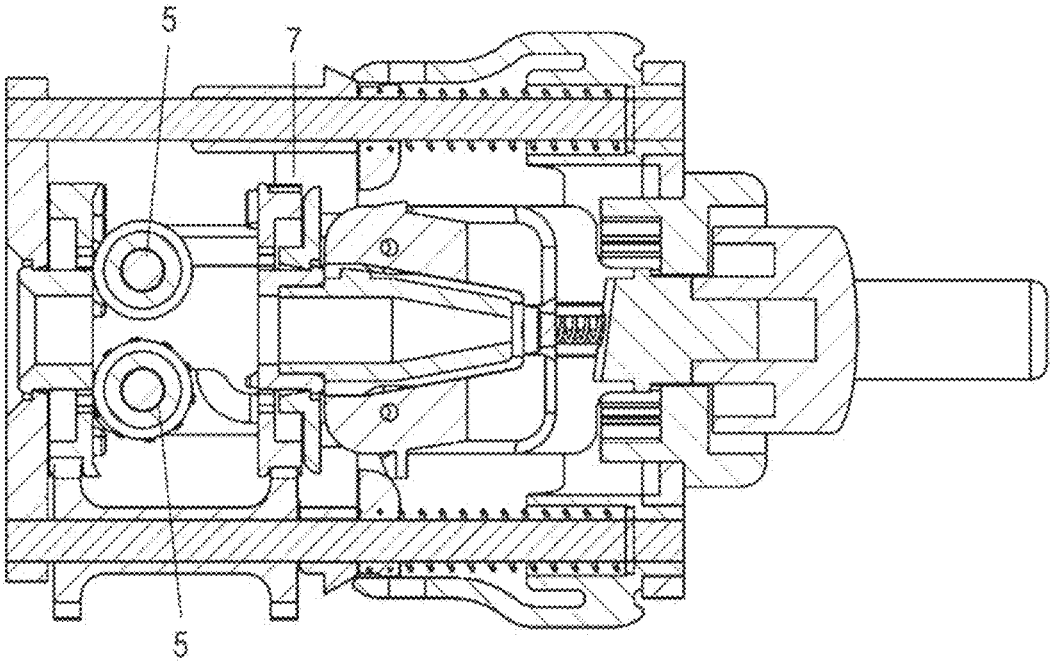

FIGS. 6(*a*) and 6(*b*) and 7(*a*) and 7(*b*) are diagrams for explaining the state where the pencil is not inserted. FIGS. 6(*a*) and 6(*b*) are an A-A side view and a B-B cross-sectional view in FIGS. 2(*a*) and 2(*b*). Moreover, FIGS. 7(*a*) and 7(*b*) are main part schematic diagrams for explaining an important inventive concept of the present invention, and are a main part top view and a main part side view when viewed in an insertion unit direction from the cutter frame side.

Figure 7:
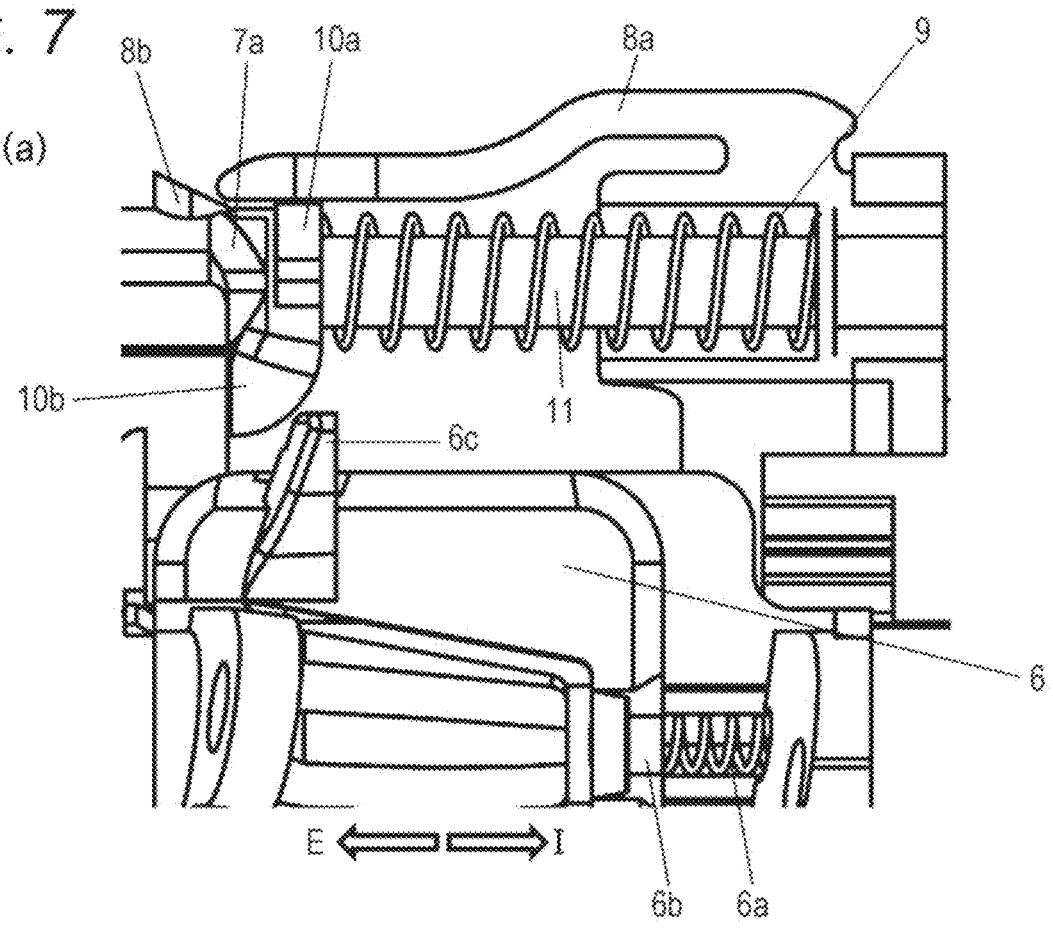
FIGS. 7(*a*) and 7(*b*) are main part schematic diagrams of the pencil sharpener of the present invention in the state where the pencil is not inserted, and are a main part top view and a main part side view when viewed in an insertion unit direction from the cutter frame side.
Figure 7:
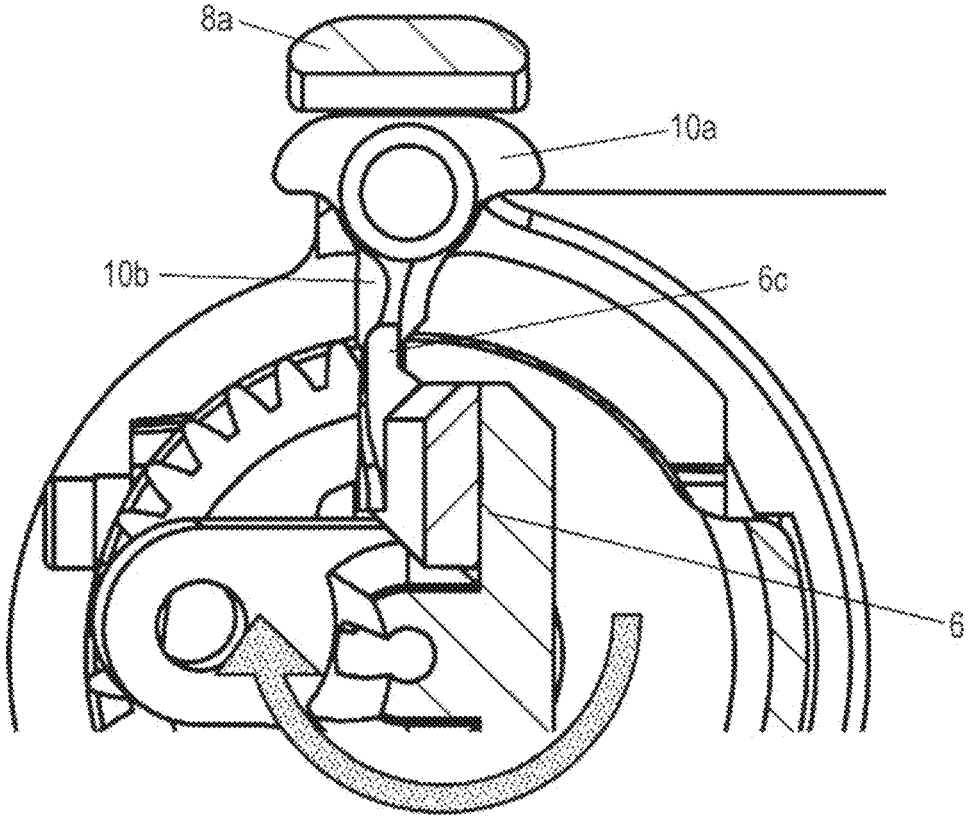

As illustrated in FIGS. 7(*a*) and 7(*b*), a projection lock 8*a* supported by the casing, and a projection 8*b* supported by a slide unit 7 configure a slide unit locking means.

Moreover, a rail guide 7*a* supported by the slide unit 7 translates along a rail 11 supported by the casing. A cam 10*a* that translates along the rail 11 is provided on the pencil insertion side of the rail guide 7*a*. Moreover, the cam 10*a* is provided with a transmitted portion 10*b* in a position that can come into contact with the transmission portion 6*c* of the core tip detection unit 6. The cam 10*a* having the transmitted portion 10*b* configures a slide unit unlocking means, and plays a role in releasing the fixation of the slide unit 7 fixed by the above-mentioned slide unit locking means. A slide unit elastic means 9 biases the slide unit 7 and the cam 10*a* in the pencil ejection direction.

In FIGS. 5(*a*) and 5(*b*), for convenience's sake, only one side of the core tip detection unit 6 is illustrated. However, there is also a similar configuration below the core tip detection unit 6 in FIGS. 5(*a*) and 5(*b*).

In the state where the pencil is not inserted, the slide unit 7 and the cam 10*a* are biased by the slide unit elastic means 9 and are located closer to the pencil ejection side. In this state, the projection lock 8*a* and the projection 8*b* are away from each other, and the slide unit 7 is in an unlocked (unfixed) state.

Moreover, the core tip detection unit 6 is biased by the detection unit elastic means 6*a*, and is located closer to the pencil ejection side.

In this state, the transmitted portion 10*b* is on the pencil ejection side with respect to the transmission portion 6*c*, and does not come into contact even if the core tip detection unit 6 rotates about a dot-and-dash line of FIGS. 5(*a*) and 5(*b*) as an axis of rotation.

<Operations of Pencil Sharpener>

Next, the operations of the pencil sharpener of the present invention are sequentially described in detail from before pencil insertion to pencil ejection, using FIGS. 6(*a*) to 15(*b*). In the drawings, in order to avoid complexity of the drawings, descriptions of symbols of components are kept to a minimum required for explanation.

As illustrated in FIG. 6(*b*), when the pencil is inserted from the insertion unit, the pencil presses the pair of feed rollers being the feed roller 5 in the insertion direction. The insertion pressure moves the feed roller 5 and the slide unit 7 that supports the feed roller 5 to the pencil insertion side. The pencil insertion pressure forces the pair of feed rollers open to insert the pencil into the pair of feed rollers.

Figure 8:
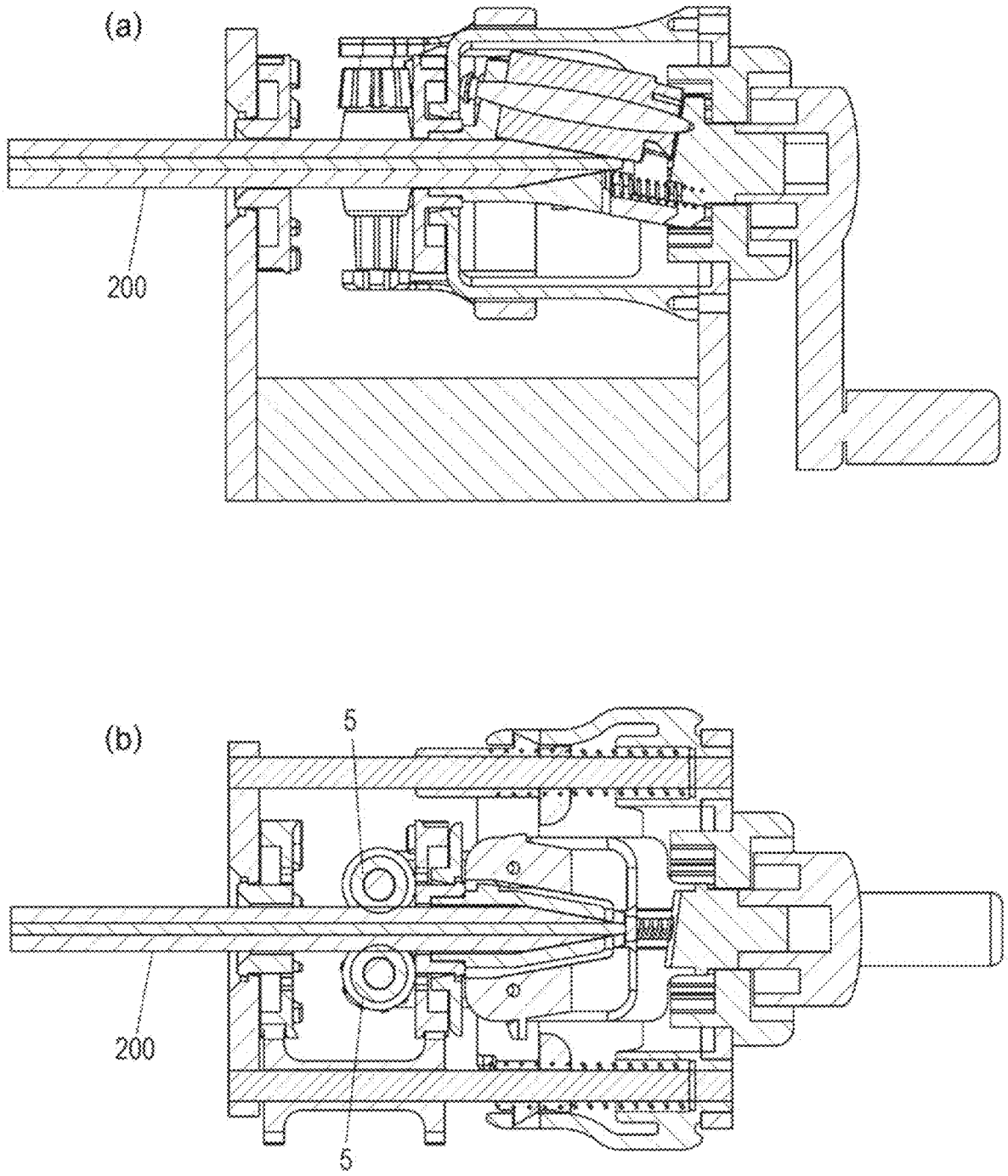
FIGS. 8(*a*) and 8(*b*) are an A-A side view and a B-B cross-sectional view of the pencil sharpener of the present invention in a state where the pencil has been inserted.

Next, a state where the pencil has been inserted is described using FIGS. 8(*a*) and 8(*b*) and 9(*a*) and 9(*b*).

A translation position of the slide unit 7, which has been moved by the pencil insertion pressure to the pencil insertion side, is locked as illustrated in FIGS. 7(*a*) and 7(*b*). In other words, the projection lock 8*a* and the projection 8*b* are fitted to each other to put the slide unit 7 into a locked state.

Moreover, the pencil insertion pressure causes the slide unit elastic means 9 to store elastic energy.

Moreover, the core tip detection unit 6 is biased by the detection unit elastic means 6*a*, and is located closer to the pencil ejection side as in FIGS. 5(*a*) and 5(*b*).

Figure 9:
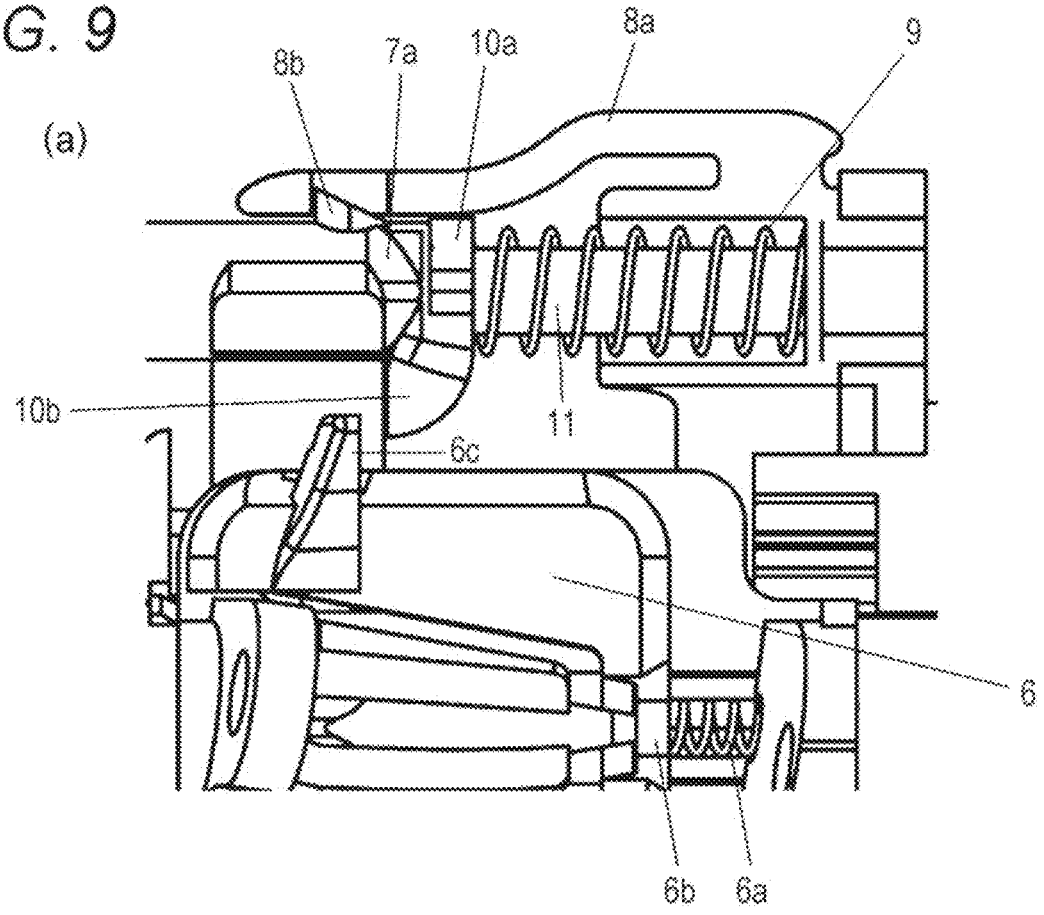
FIGS. 9(*a*) and 9(*b*) are main part schematic diagrams of the pencil sharpener of the present invention in the state where the pencil has been inserted, and are a main part top view and a main part side view when viewed in the insertion unit direction from the cutter frame side.
Figure 9:
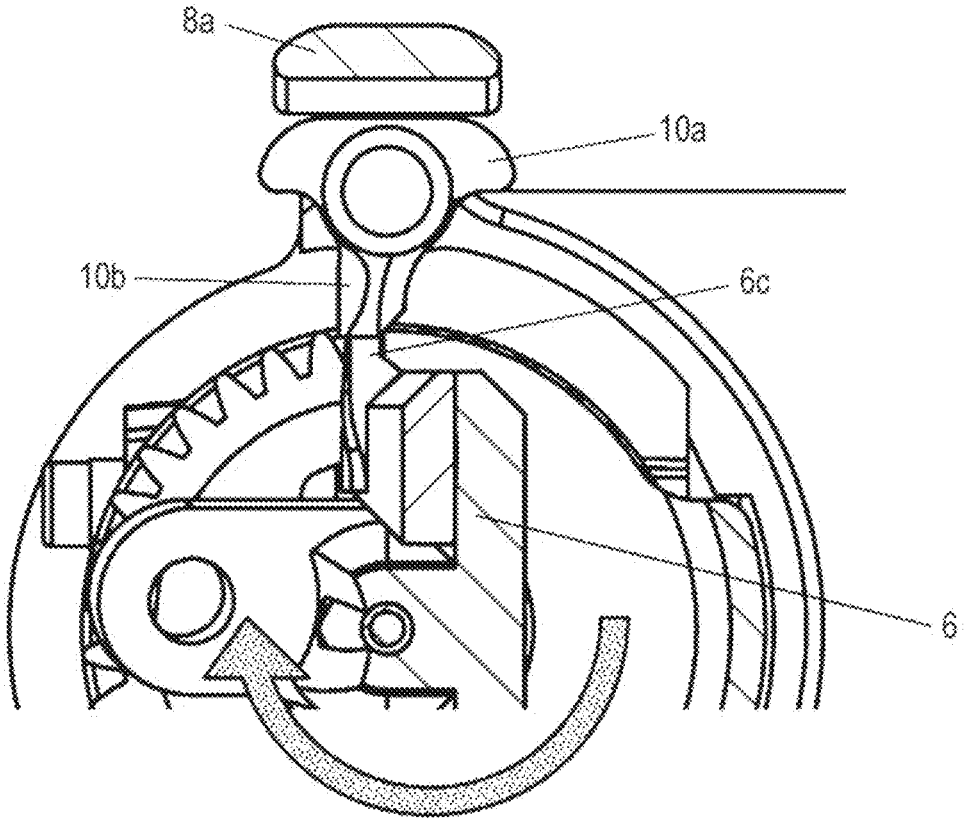

In this state, the transmitted portion 10*b* is moved by the transmission portion 6*c* to the pencil insertion side and, even if the core tip detection unit 6 rotates about a dot-and-dash line of FIGS. 9(*a*) and 9(*b*) as an axis of rotation, does not come into contact with the core tip detection unit 6. Depending on the rotation position of the core tip detection unit 6, the transmitted portion 10*b* may come into contact with the transmission portion 6*c* when moving to the pencil insertion side. However, a device for the shapes of the core tip detection unit 6 and the cam 10*a* is used to enable them to pass each other without breakage even if they come into contact with each other. For example, as illustrated in FIGS. 9(*a*) and 9(*b*), contact surfaces of the core tip detection unit 6 and the cam 10*a* are formed in inclined surfaces inclining with respect to a contact direction, and accordingly the rotation of the core tip detection unit 6 enables the core tip detection unit 6 and the cam 10*a* to pass each other without any damage even if they come into contact with each other. Moreover, even if there is not any particular device for shapes, the core tip detection unit 6 is simply biased in the ejection direction with small force. Accordingly, the core tip detection unit 6 rotates while moving in the insertion direction, and can avoid contact with the contact surface of the cam 10*a*.

Furthermore, as illustrated in FIGS. 4 and 5(*a*), the roller-specific gears 4*d* provided to the feed roller 5 are in a state of engaging with side teeth 4*aa* of the coaxial gear 4*a* provided on a pencil ejection side end of the cutter frame 3.

In this state, when the torque generation means 1 is operated and rotational torque is applied to the cutter frame 3, the coaxial gear 4*a* provided on the pencil ejection side end of the cutter frame 3 rotates, and the side teeth 4*aa* engage with the roller-specific gears 4*d* to rotate the feed roller 5. The pencil is pressed by the rotation of the feed roller 5 in the pencil insertion direction, and is shaved by the rotating cutter 3*a*.

Figure 10:
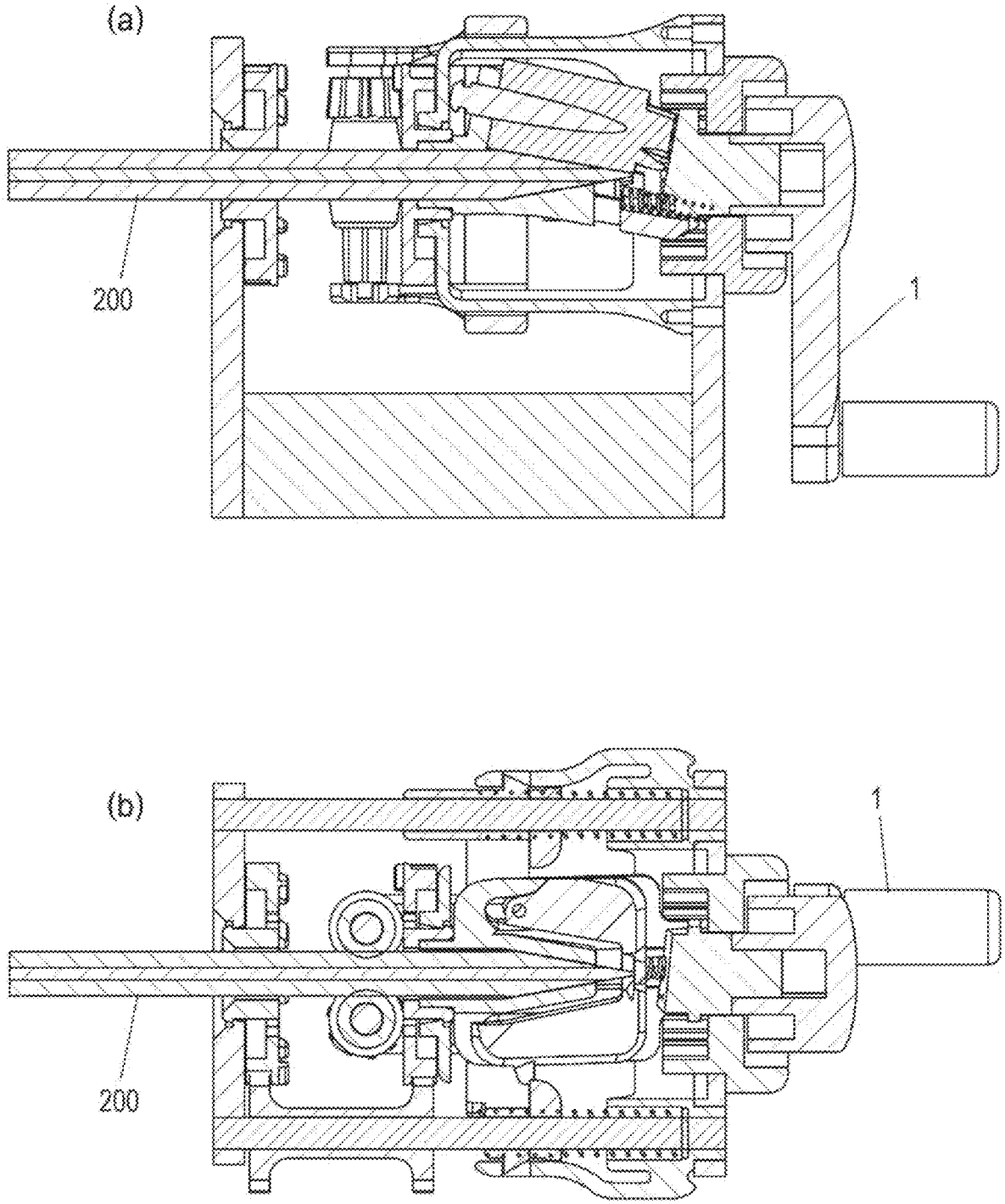
FIGS. 10(*a*) and 10(*b*) are an A-A side view and a B-B cross-sectional view of the pencil sharpener of the present invention in a shaving completed state.

In a state immediately after the shaving of the pencil is completed is described using FIGS. 10(*a*) and 10(*b*) and 11(*a*) and 11(*b*).

In the state where the shaving is completed, the core tip of the pencil is in a state of pressing the detection portion 6*b* of the core tip detection unit 6 in the pencil insertion direction. Although the core tip detection unit 6 is biased by the detection unit elastic means 6*a* in the pencil ejection direction, the biasing force is not large. Accordingly, the core tip detection unit 6 moves slightly in the pencil insertion direction. Moreover, the biasing force of the detection unit elastic means 6*a* is not large; accordingly, the core tip of the pencil is hardly damaged.

Figure 11:
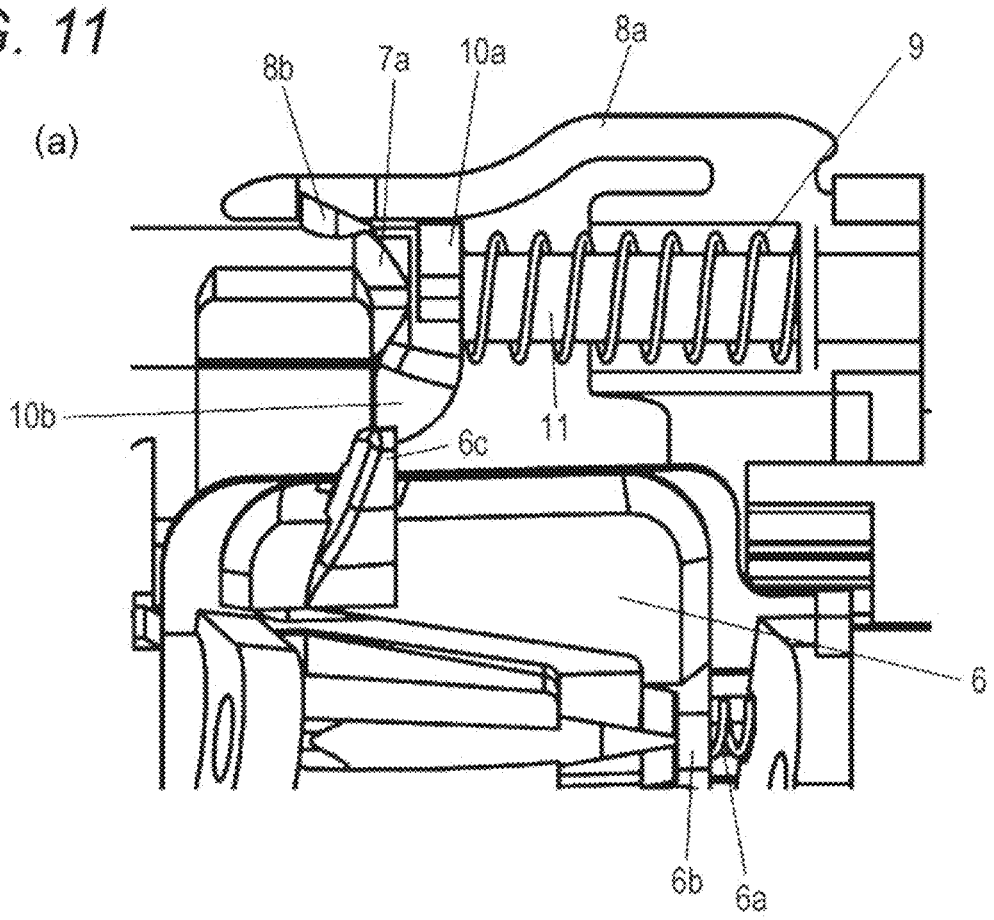
FIGS. 11(*a*) and 11(*b*) are main part schematic diagrams of the pencil sharpener of the present invention in the shaving completed state and are a main part top view and a main part side view when viewed in the insertion unit direction from the cutter frame side.
Figure 11:
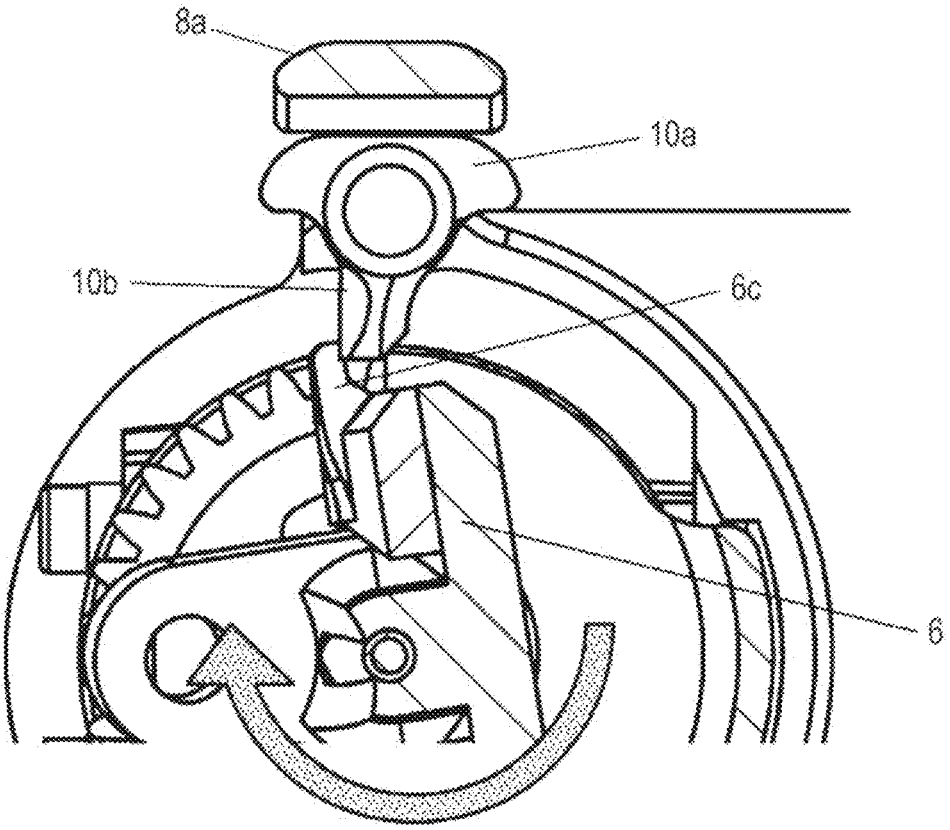
Figure 12:
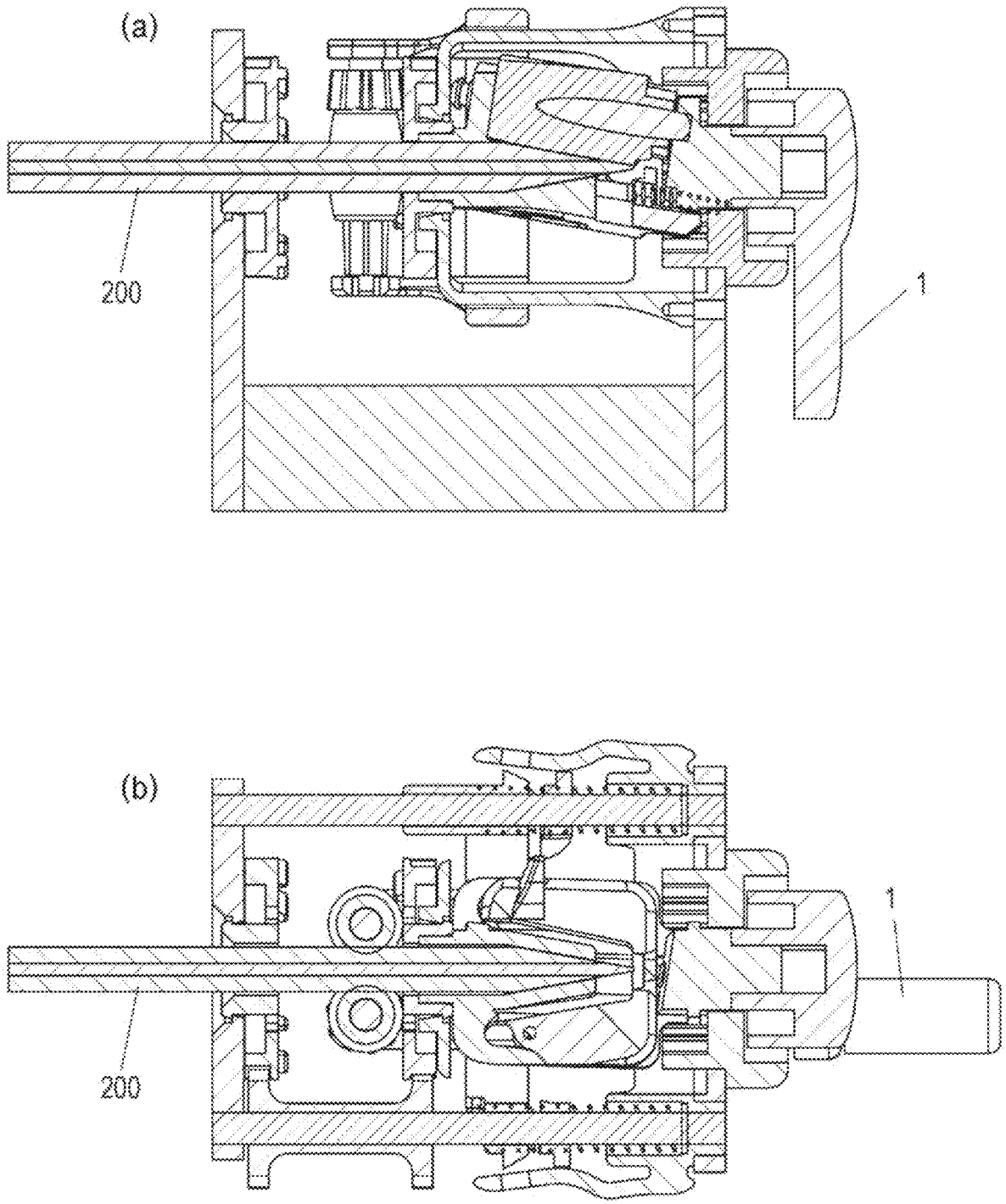
FIGS. 12(*a*) and 12(*b*) are an A-A side view and a B-B cross-sectional view of the pencil sharpener of the present invention upon an unlocking operation.
Figure 13:
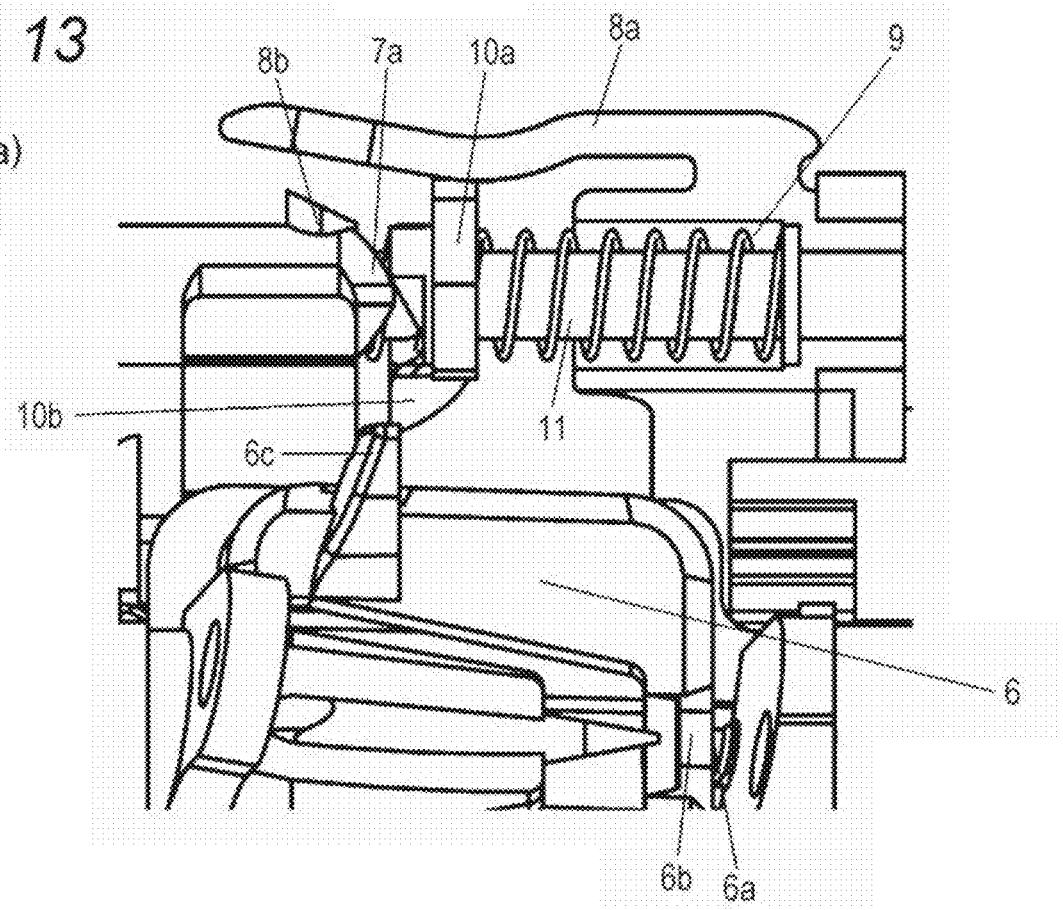
FIGS. 13(*a*) and 13(*b*) are main part schematic diagrams of the pencil sharpener of the present invention upon the unlocking operation, and a main part top view and a main part side view when viewed in the insertion unit direction from the cutter frame side.
Figure 13:
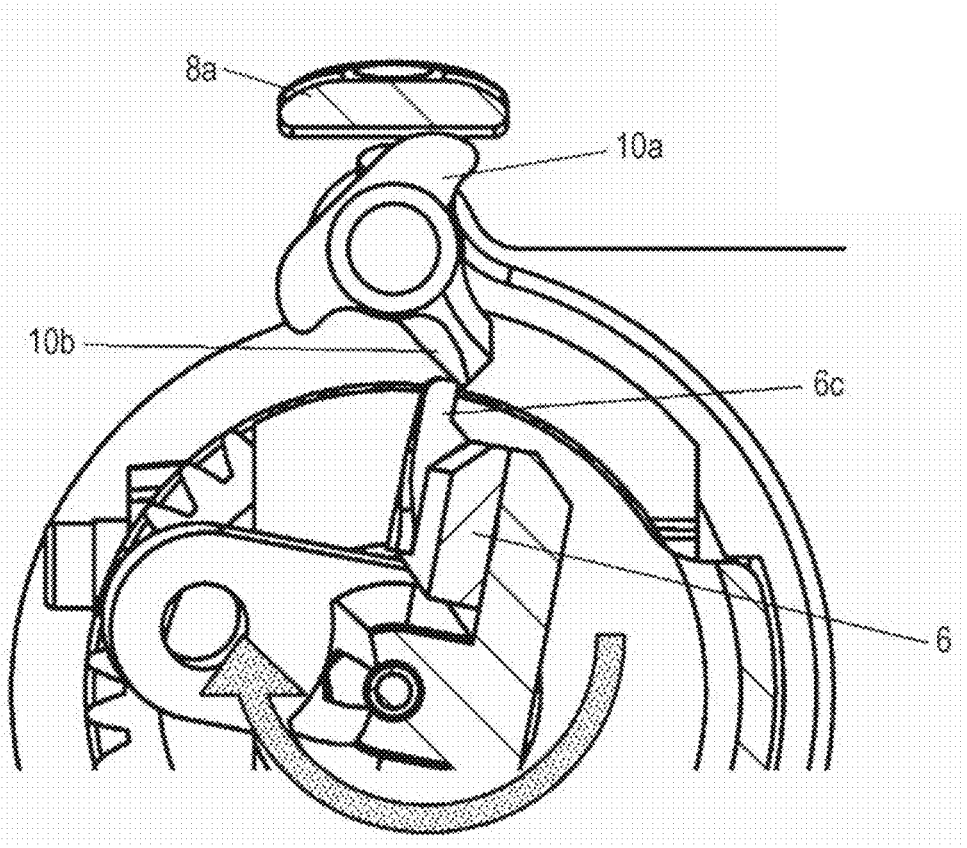
Figure 14:
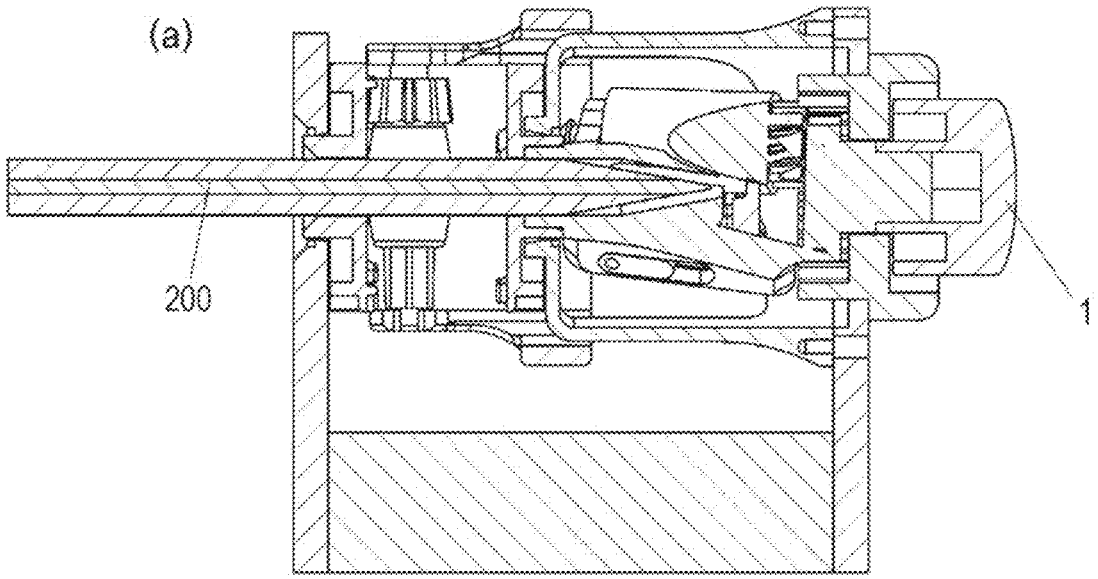
FIGS. 14(*a*) and 14(*b*) are an A-A side view and a B-B cross-sectional view of the pencil sharpener of the present invention upon pencil ejection.
Figure 14:
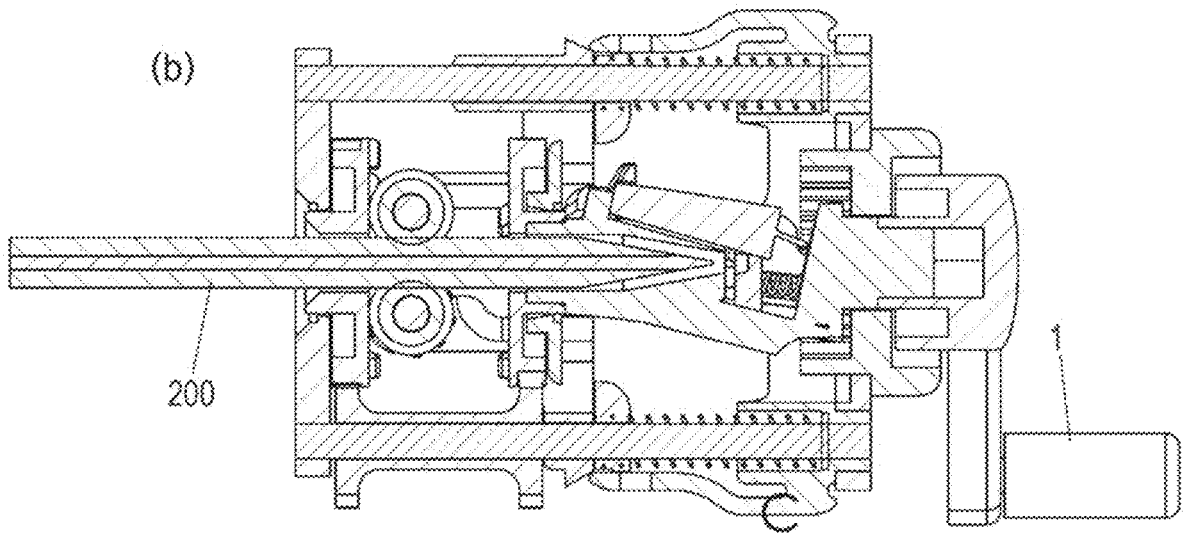

The transmission portion 6*c* of the core tip detection unit 6 has moved slightly in the pencil insertion direction, and accordingly the transmitted portion 10*b* and the transmission portion 6*c* enter a state of coming into contact with each other when the core tip detection unit 6 rotates in an arrow direction of FIG. 11(*b*). In this state, the torque generation means 1 is in the operating state. Accordingly, the transmitted portion 10*b* and the transmission portion 6*c* come into contact with each other, and the rotational torque generated by the core tip detection unit 6 rotates the cam 10*a*. The cam 10*a* has a shape illustrated in FIG. 11(*b*), and the cam 10*a* is rotated to press the projection lock 8*a* upward. Accordingly, the locked state of the slide unit 7 is released (FIGS. 12(*a*) and 12(*b*) and 13(*a*) and 13(*b*)).

The slide unit 7 of which locked state has been released is pressed out in the pencil ejection direction by the slide unit elastic means 9 where the elastic energy has been stored. The feed roller 5 supported by the slide unit 7, together with the pencil, is also pressed out in the pencil ejection direction. The feed roller 5 and the slide unit 7 return to the states before pencil insertion illustrated in FIGS. 6(*a*) and 6(*b*) and 7(*a*) and 7(*b*).

As illustrated in FIG. 5(*b*), the roller-specific gears 4*d* provided to the feed roller 5 enter a state of engaging with side teeth 4*bb* of the coaxial gear 4*b* provided near the insertion unit. In this state, the torque generation means 1 is in the operating state, and the coaxial gear 4*a* is rotated to rotate the coaxial gear 4*b* provided near the insertion unit in the same direction as the rotation of the coaxial gear 4*a*, via the transmission gear 4*c*. The side teeth 4*bb* then engage with the roller-specific gears 4*d*, and rotate the feed roller 5. The coaxial gears 4*a* and 4*b* rotate in the same direction. However, the positional relationships between the side teeth 4*aa* and 4*bb* and the coaxial gears 4*a* and 4*b* are a back-and-front relationship. Accordingly, the rotation of the feed roller 5 rotates in the direction where the pencil is ejected to eject the pencil from the insertion unit.

In a summary of the above-mentioned operations, the pencil sharpener of the embodiment performs roughly five operations.

A first operation is the operation upon inserting the pencil. The pencil is inserted to press in the slide unit 7 in the pencil insertion direction and lock the slide unit 7. The energy upon press-in is stored in the slide unit elastic means 9 being a slide unit ejection means. Moreover, the feed roller 5 is also pressed in. Accordingly, when the torque generation means 1 is operated, the feed roller 5 rotates together with the rotation of the cutter frame 3 via the rotation axis conversion means to introduce the pencil 200 into the cutter frame.

A second operation is the shaving operation. The pencil 200 is shaved by the cutter 3*a* in a state of being biased by the feed roller 5 into the cutter frame.

A third operation is the operation of detecting the completion of the shaving of the pencil 200. As the pencil 200 is increasingly shaved, the position of the core tip moves in the pencil insertion direction. Immediately before entering the predetermined fully sharpened state, the transmission portion 6*c* of the core tip detection unit 6 (the sharpening completion detection means) is pressed in the pencil insertion direction, and moves in the pencil insertion direction. Consequently, the rotation path of the transmission portion 6*c* moves in the pencil insertion direction, and the rotational torque of the rotating core tip detection unit 6 transmits that the pencil 200 has entered the predetermined fully sharpened state to the shaving stop means and the shaving completion notification means. In the embodiment, especially the shaving stop means has been described.

A fourth operation is the shaving stop means, which is a means that unlocks the slide unit. The unlocked slide unit 7, together with the feed roller 5, moves in the pencil ejection direction, and returns to the state before pencil insertion. The pencil 200 held between the pair of rollers of the feed roller 5 also moves in the pencil ejection direction. Consequently, the shaving stops.

A fifth operation is the operation of ejecting the pencil from the pencil sharpener. The feed roller 5 rotates backward to eject the pencil.

In this manner, a distinctive feature is in that a series of operations is achieved by the rotation of the torque generation means 1 in the same direction.

The main operations of the pencil sharpener of the embodiment are as described above. Devised points are mentioned further below.

As illustrated in FIGS. 7(*a*) and 7(*b*), the contact surfaces of the rail guide 7*a* and the cam 10*a* are designed to be not perpendicular but inclined surfaces. Consequently, the transmission portion 6*c* rotates the cam 10*a*, and the cam 10*a* is always at a fixed rotation angle position excluding when pressing the projection lock 8*a* upward. The cam 10*a* does not hinder the lock mechanism of the slide unit 7, and can reliably come into contact with the transmission portion 6*c*.

Not only that, when coming into contact with the transmission portion 6*c*, the cam 10*a* moves in the pencil insertion direction with rotation. Consequently, a pressure can be applied in the pencil insertion direction to the transmission portion 6*c* in contact. Therefore, the core tip detection unit 6 moves in a direction away from the core tip of the pencil 200, releases the pressure on the core tip early, and accordingly can protect the core tip.

Figure 15:
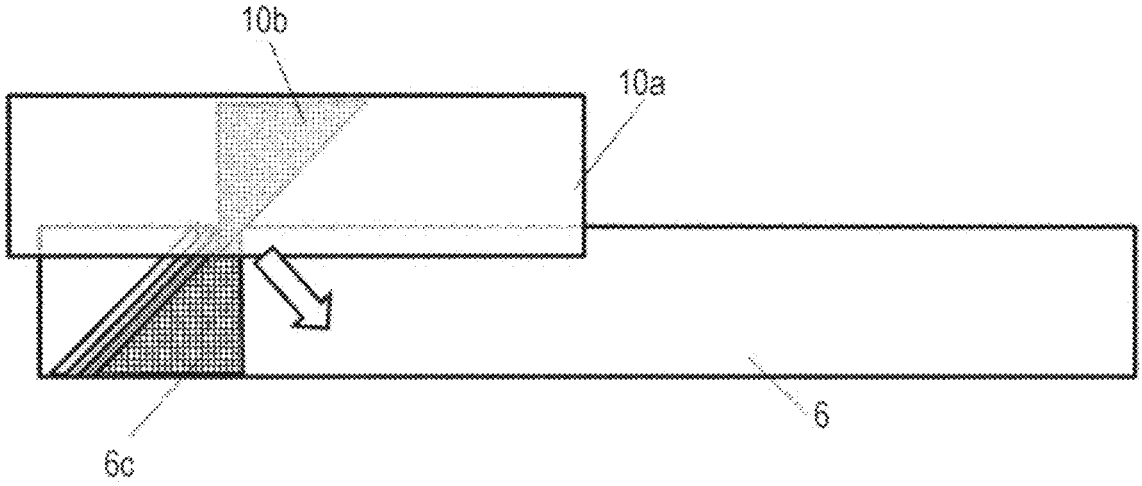
FIGS. 15(*a*) and 15(*b*) are explanatory diagrams related to a transmission portion of the pencil sharpener of the present invention in the shaving completed state.
Figure 15:
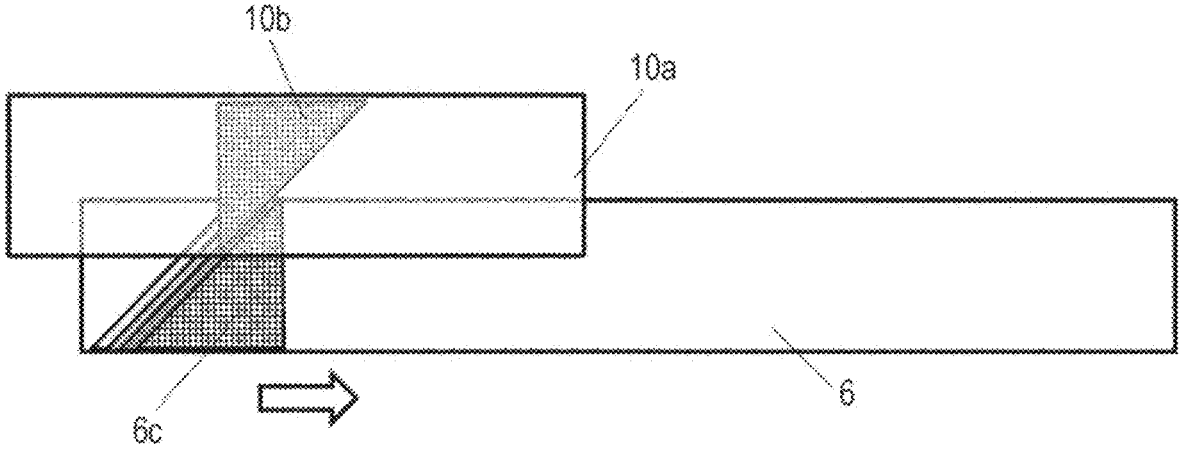

Furthermore, in order to ensure the effects, the transmission portion 6*c* and the transmitted portion 10*b* of the cam 10*a* are simply required to be formed into shapes illustrated in FIGS. 15(*a*) and 15(*b*). FIGS. 15(*a*) and 15(*b*) are diagrams of the transmission portion 6*c* and the transmitted portion 10*b* when viewed from the right in FIGS. 11(*a*) and 11(*b*). In order to make the transmission portion 6*c* hidden by the transmitted portion 10*b* easier to see, the transmitted portion 10*b* is made translucent.

The contact surfaces of the transmission portion 6*c* and the transmitted portion 10*b* are formed in inclined surfaces in this manner to ensure the transmission of power. Moreover, power from the transmitted portion 10*b* acts on the transmission portion 6*c* in a direction indicated by an open arrow in FIG. 15(*a*). Therefore, movement is made to the transmission portion 6*c* in a direction indicated by an open arrow in FIG. 15(*b*). In other words, almost concurrently with the contact between them, the core tip detection unit 6 moves in the direction away from the core tip of the pencil 200 and can release the pressure on the core tip early.

<Examples of Feasible Configurations Other than Above>

In the embodiment, one form of the optimal pencil sharpener has been illustrated as described above. The present invention is not limited to the configuration of the embodiment. Even different configurations illustrated below can obtain similar significant effects.

For example, in terms of the core tip detection unit 6, the mechanism that translates with respect to the cutter frame 3 is illustrated. However, even a mechanism that rotates about a direction perpendicular to the paper surface of FIG. 7(*b*) with respect to the cutter frame 3 can perform similar operations.

Moreover, if a mechanism that moves the position of the detection portion 6*b* or the transmission portion 6*c* relatively in the pencil insertion direction or ejection direction is provided to the core tip detection unit 6's body, the fully sharpened state of the pencil can be changed. In other words, a fully sharpened state adjustment function can be provided.

The slide unit elastic means 9 is illustrated as the slide unit ejection means, and the detection unit elastic means 6*a* as the detection unit biasing means. Both of them are elastic means using a spring or the like, but are not necessarily limited to the elastic means. For example, magnetic force acting between magnets or between a magnet and magnetic metal may be used.

The energy of inserting the pencil from the insertion unit is used as the energy required to eject the slide unit 7, which is stored in the slide unit ejection means. However, another energy may be used. For example, in a case of an electric pencil sharpener, it may be provided with a mechanism that detects insertion of a pencil from the insertion unit and allows the insertion of the pencil, and also moves the slide unit 7 in the insertion direction with a motor or the like.

Moreover, the mechanism that locks the slide unit 7 is not limited to the configuration that fits to each other, but may be a configuration using magnetic force or the like. As long as a mechanism is included which fixes or releases the translation position when the slide unit 7 is pressed in the pencil insertion direction, any configuration is acceptable. What is required is a configuration that stores energy upon a user inserting the pencil 200 in the elastic means, and moves the slide unit 7 in the pencil ejection direction, using the stored energy, when unlocking.

The configuration including the rotation axis conversion means 4 and the feed roller 5 is illustrated as the pencil biasing means. However, the pencil biasing means may be a configuration other than this. For example, it may be a combination of conversion means that converts the rotation of the cutter frame 3 into translational motion in the pencil insertion and ejection directions, and means that holds a pencil translated by the conversion means. The conversion means that converts rotation into translational motion may use a worm gear as in a monkey wrench. The means that holds a pencil may be any mechanism as long as it is a mechanism that can add a holding force to a pencil using deformation or the like of resin since the means does not need to rotate as in the feed roller 5.

Moreover, the mechanism that ejects the pencil 200 from the pencil sharpener is not limited to the combination of the plurality of gears as illustrated above, and can be any configuration as long as it is a mechanism that can rotate the feed roller 5 backward.

Furthermore, some mechanisms illustrated in the example can be used independently of each other.

For example, the sharpening completion detection means using the core tip detection unit 6 may be combined with another shaving stop means. If the movable slide unit is not included and the position of the feed roller is fixed, a gearshift mechanism that reverses the direction of rotation of the feed roller may be included. The sharpening completion detection means in the present invention does not drive the shaving stop means by the pressure of the core tip, but can drive the shaving stop means by the rotational torque of the core tip detection unit 6, that is, the large rotational torque generated by the torque generation means 1. Accordingly, the complicated gearshift mechanism can be driven. Therefore, the core tip is not damaged.

Moreover, if not the shaving stop means but the shaving completion notification means is combined and used, a conventional type of pencil biasing means that pulls out a spring chuck can also be used as the pencil biasing means.

Moreover, the shaving stop means can also be used in combination with another sharpening completion detection means. For example, in a case of an electric pencil sharpener, it is also easy to separately drive a mechanism that detects that the core tip has reached a predetermined position with a pressure gauge or the like, and unlock the slide unit 7.

Furthermore, also in the operation of ejecting the pencil from the pencil sharpener, which is the fifth operation, the biasing direction of the pencil biasing means is reversed, triggered by the sharpening completion detection means. It is a series of operations: the sharpening completion detection means detects completion of the shaving of the pencil; the slide unit locking means is released; and the biasing direction of the pencil biasing means is reversed. In this operation, for example, a user may perceive completion of sharpening from a fact that the rotation of the crank has become light, activate a switch for the slide unit locking means provided outside the pencil sharpener to unlock, and unlock the slide unit locking means. Therefore, the slide unit unlocking means may be configured in such a manner as to operate by the switch provided outside the pencil sharpener.

Features of Present Invention

Lastly, many excellent features of the pencil sharpener according to the present invention are summarized.

Firstly, when a pencil is fully sharpened, it is possible to reliably detect completion of the sharpening, and prevent unnecessary sharpening of the pencil. Especially, it is possible to reliably stop sharpening even a pencil with a soft core such as a colored pencil. In a case of a known pencil sharpener, it is necessary to perceive the completion of shaving a pencil with a soft core by a sense, and it is difficult to prevent unnecessary sharpening.

Moreover, the shaving stop means is not driven by the pressure of the core tip. However, the shaving stop means can be driven by the large rotational torque generated by the torque generation means 1. Accordingly, the complicated mechanism can be driven. Consequently, the core tip is not damaged, either. The core tip simply presses the detection portion 6*b* against the small force of biasing the detection portion 6*b*. Accordingly, the reaction force applied to the core tip is small, and even in a case of a pencil with a soft core, the core tip is not worn, or the tip is not broken, either.

It is difficult in pencil sharpeners that are currently in wide use to appropriately set the force of the feed roller to insert the pencil into the cutter frame. If the insertion force is too large, when the tip of the pencil comes into contact with a stopper, the shaving does not stop. Conversely, if the insertion force is too small, the shaving cannot be performed. Moreover, pencils have different shapes such as hexagons and cylindrical shapes, and are also subtly different in diameter according to the manufactures and the like. Accordingly, the setting of the insertion force is more difficult. In the present invention, the pencil escapes from the shaving unit. Accordingly, there is no risk of sharpening too much even if the insertion force of the feed roller is set to be sufficiently large. The setting of the insertion force is facilitated very much, and the finished quality of sharpening can be improved.

Moreover, the torque generation means 1 can perform operations automatically from shaving to pencil ejection by generating rotational torque in the same direction. In a hand crank pencil sharpener, it is almost impossible to reverse the direction of rotation in the middle. Moreover, in a case of an electric pencil sharpener, it is possible to reverse the direction of rotation of the motor, triggered by a signal for completion of sharpening. However, the mechanism is complicated, and there arise problems in cost and the like. In the present invention, for example, also a hand crank pencil sharpener can perform operations automatically from shaving to pencil ejection during rotation in the same direction, which is a very excellent feature. Workability is significantly improved. In addition, a feeling of comfort can also be given to a user.

Second Embodiment

In the first embodiment, the configuration has been described in which the pencil biasing means that converts the rotation of the cutter frame into the motion of biasing a pencil in the insertion direction and biases the pencil in the insertion direction is capable of translating in the pencil insertion direction and the pencil ejection direction. In other words, the configuration has been disclosed which stores energy that is generated by the pencil biasing means moving in the pencil insertion direction when the pencil is inserted, releases the energy in conjunction with the sharpening completion detection means, and accordingly translates the pencil biasing means in the pencil ejection direction to move the pencil in the pencil ejection direction.

On the other hand, in the second embodiment, a configuration is described in which the pencil biasing means does not translate in the pencil insertion direction and the pencil ejection direction. The pencil biasing means does not translate. Accordingly, a new configuration that stores the energy that is generated when a pencil is inserted is provided.

A description is given below using FIGS. 16 to 19. In the drawings, the same reference signs are assigned to portions having similar functions to the first embodiment.

Figure 16:
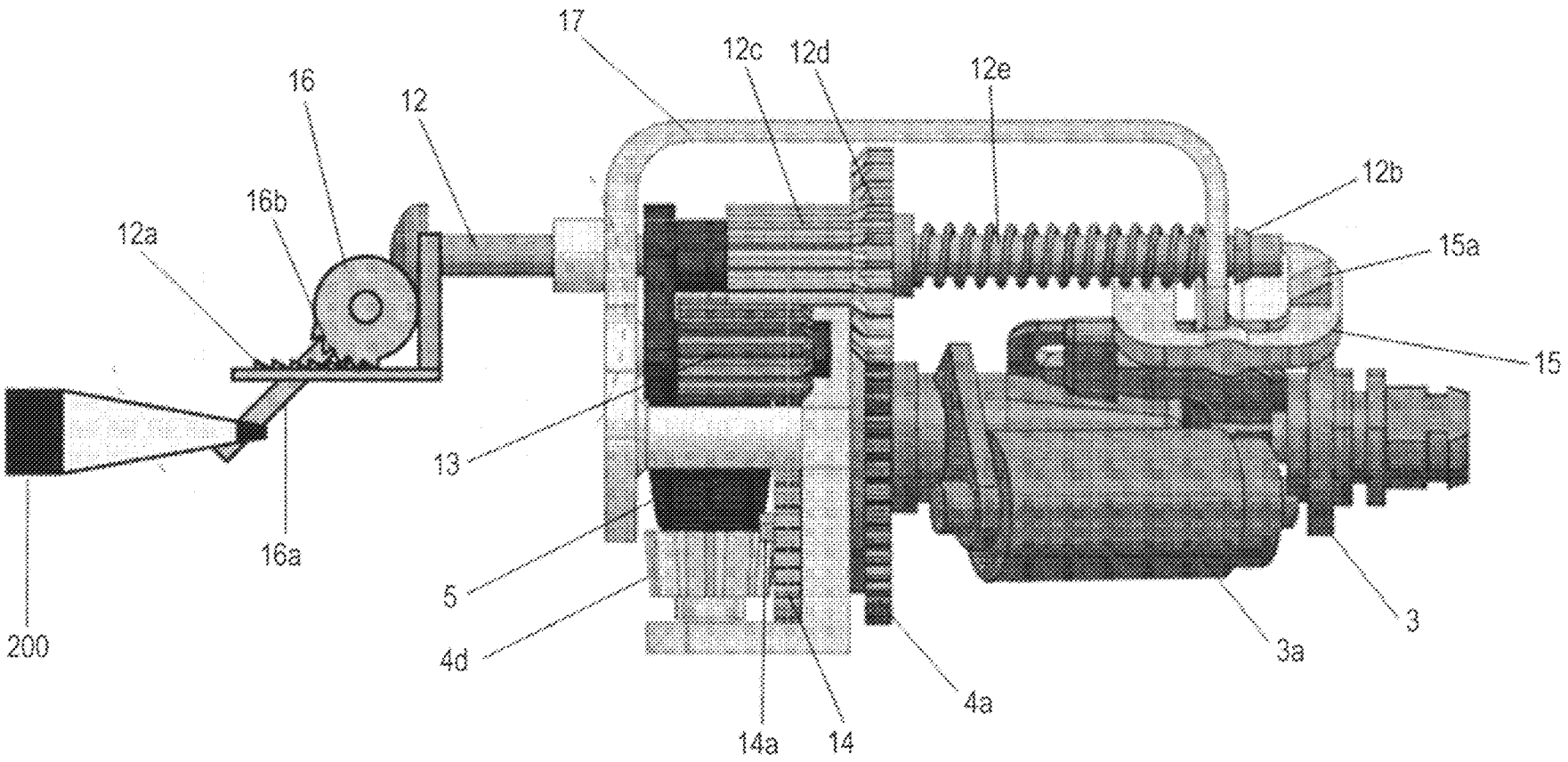
FIG. 16 is a main part schematic diagram of a pencil sharpener of a second embodiment of the present invention in a state immediately before the pencil is inserted.

FIG. 16 is a main part schematic diagram in a state immediately before a pencil 200 is inserted. A reference sign 3 denotes a cutter frame including a cutter 3*a*, 4*a* denotes a coaxial gear, 4*d* denotes a roller-specific gear, and 5 denotes a feed roller being a pencil biasing means. A reference sign 12 denotes a rod-like member that can translate in pencil insertion and ejection directions. The rod-like member 12 is provided at one end with a press-in plane gear 12*a*, and near the other end with a projection 12*b*. Moreover, a first transmission gear 12*c* and a second transmission gear 12*d* are supported by the rod-like member 12 in such a manner as to be rotatable. Furthermore, the rod-like member 12 is also provided with an elastic means 12*e* such as a spring. A reference sign 13 denotes a third transmission gear, and 14 denotes a fourth transmission gear including a side tooth 14*a*. A reference sign 15 denotes a locking means including a locking means projection 15*a*. A reference sign 16 denotes a rotating plate including a contact portion 16*a* and a rotation gear 16*b*. A reference sign 17 denotes a frame fixed to a casing to support the energy storing means 12 in such a manner as to be capable of translating.

Figure 17:
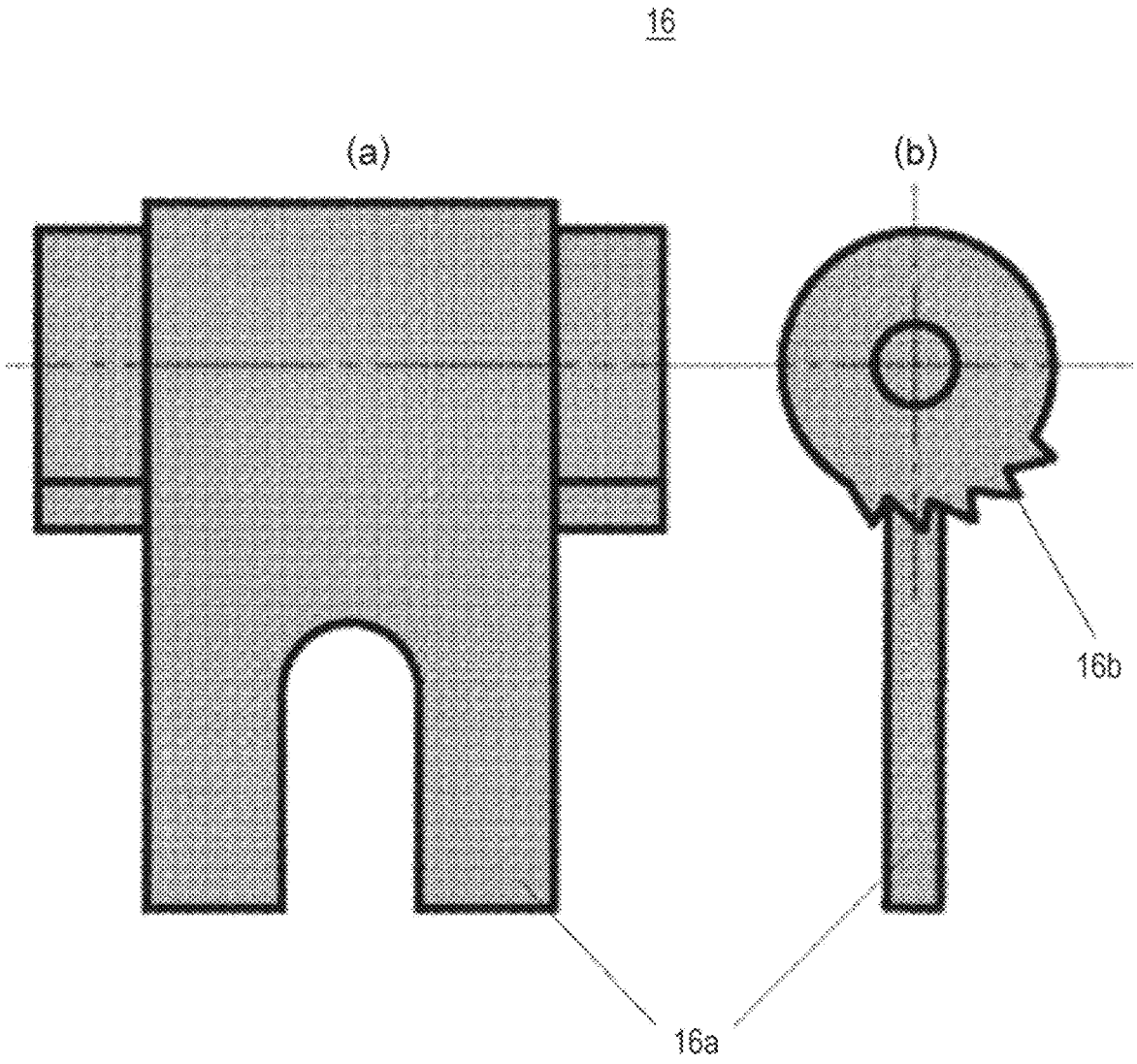
FIGS. 17(*a*) and 17(*b*) are a front view and a side view of a rotating plate of the pencil sharpener of the second embodiment of the present invention.

FIGS. 17(*a*) and 17(*b*) are a front view and a side view of the rotating plate 16. The contact portion 16*a* is provided with an opening in such a manner as to prevent contact with the core of a pencil for the purpose of preventing the core from damaging, and is configured in such a manner as to come into contact with a portion around the core.

Next, operations are described.

Figure 18:
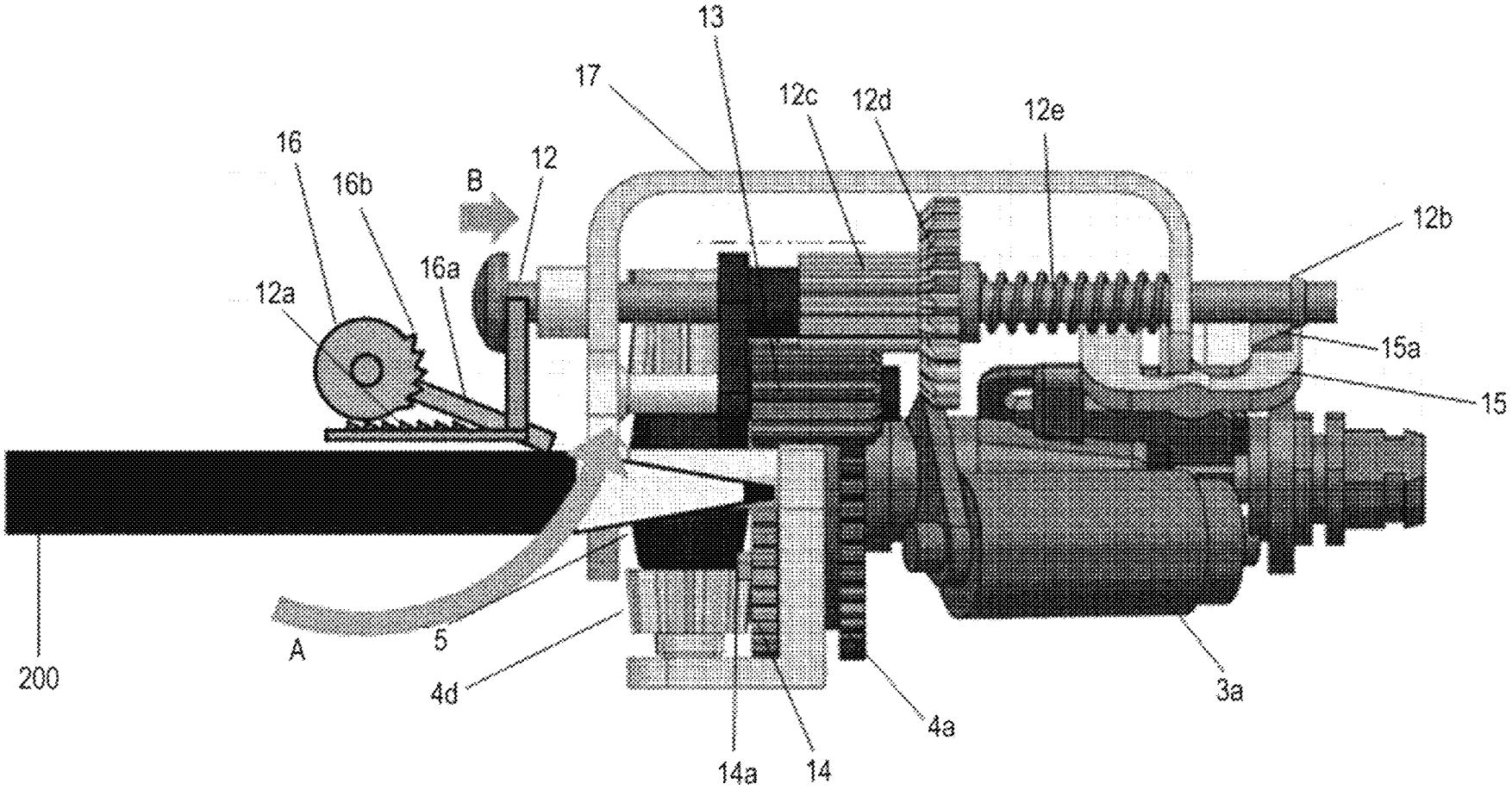
FIG. 18 is a main part schematic diagram of the pencil sharpener of the second embodiment of the present invention in a state after the pencil is inserted.

When the pencil 200 is inserted, the portion around the core of the pencil 200 comes into contact with the contact portion 16*a* of the rotating plate 16 to press the rotating plate 16 upward in an arrow A direction in FIG. 18. The rotation gear 16*b* of the rotating plate 16 engages with the press-in plane gear 12*a* of the energy storing means to press in the rod-like member 12 in an arrow B direction, that is, the pencil insertion direction. With this operation, the elastic means 12*e* provided to the rod-like member 12 is contracted to store the elastic energy. Moreover, the projection 12*b* moves over the locking means projection 15*a* of the locking means 15. Accordingly, the projection 12*b* cannot move to the left in the drawing due to the locking means projection 15*a*. Therefore, the rod-like member 12 is locked in a position illustrated in FIG. 18.

The pencil is shaved in this state. In the drawing, an illustration of a means that detects completion of sharpening is omitted. However, a configuration similar to the core tip detection unit 6 illustrated in the first embodiment is provided. The completion of the sharpening is detected. An operation similar to the one in the first embodiment in which the transmission portion 6*c* moves slide unit unlocking means 10 allows the locking means 15 to move. The locking means projection 15*a* moves away from the projection 12*b*, and the energy storing means is unlocked. When the energy storing means is unlocked, the contracted elastic means 12*e* extends. Accordingly, the energy storing means moves to the left. This state is illustrated in FIG. 19.

Figure 19:
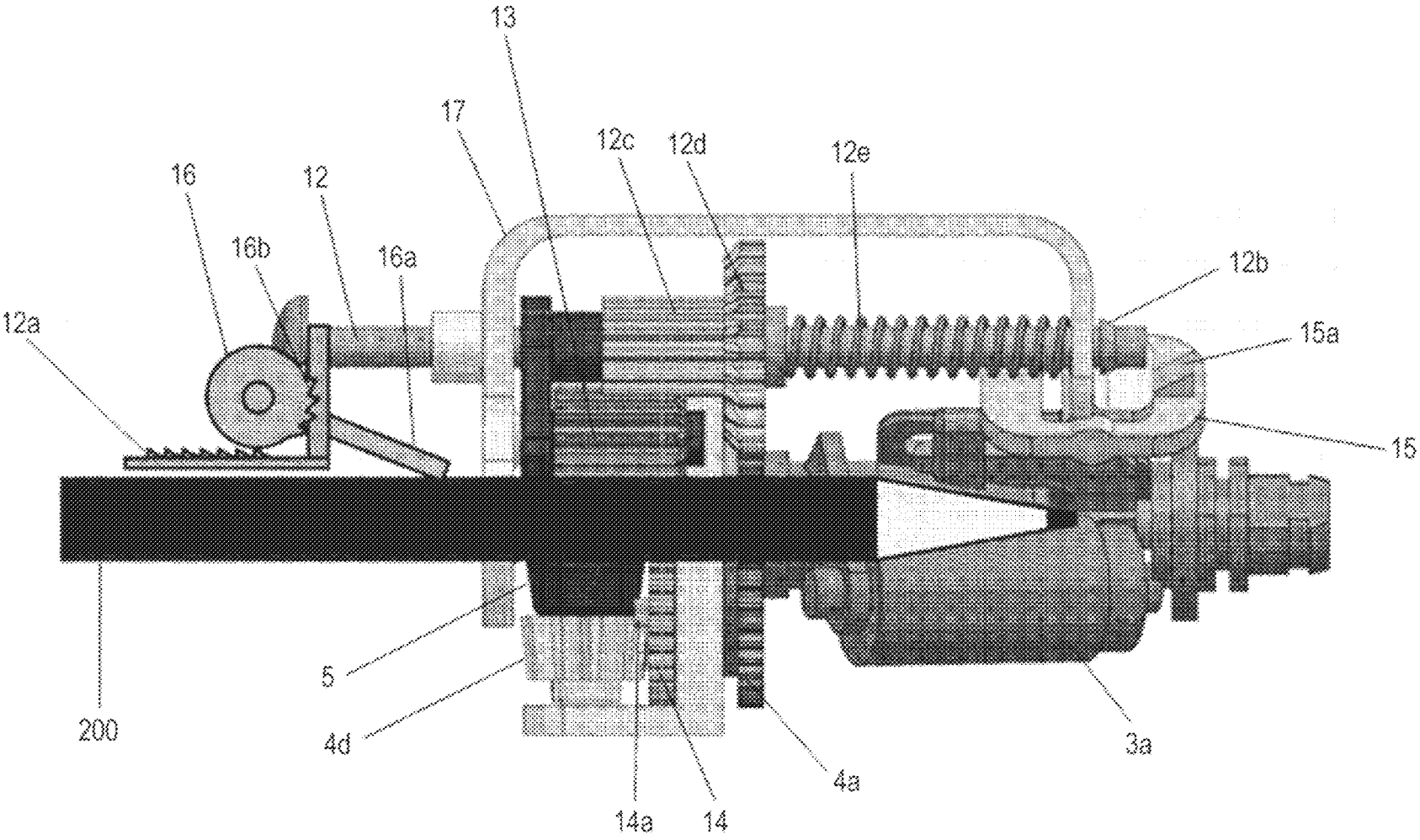
FIG. 19 is a main part schematic diagram of the pencil sharpener of the second embodiment of the present invention in a state after completion of the shaving is detected.

In FIGS. 18 and 19, the direction of rotation of the feed roller 5 being the pencil biasing means is reversed.

In FIG. 18, the coaxial gear 4*a* that rotates together with the cutter frame 3 rotates the fourth transmission gear 14 via the third transmission gear. The side tooth 14*a* provided on a side surface of the fourth transmission gear 14 rotates the roller-specific gear 4*d*. In this manner, the pencil 200 is biased by the feed roller 5 in the pencil insertion direction after the pencil is inserted.

On the other hand, in FIG. 19, the coaxial gear 4*a* rotates the second transmission gear 12*d*, and the first transmission gear 12*c* that rotates together with the second transmission gear 12*d* rotates the fourth transmission gear 14 via the third transmission gear. At this point in time, the direction of rotation of the fourth transmission gear 14 is reversed from the direction of rotation in FIG. 18. Therefore, the pencil 200 is biased by the feed roller 5 in the pencil ejection direction after detection of completion of sharpening.

As described above, the pencil can be biased in the pencil insertion direction when being sharpened, and biased in the pencil ejection direction after the sharpening is completed, as in the first embodiment, without translating the pencil biasing means.

As illustrated in the first and second embodiments described above, the pencil sharpener according to the present invention includes: the casing; the torque generation means that generates rotational torque by manual rotation of a crank or an electric motor; the insertion unit into which a pencil is insertable; the cutter frame that has the cutter to shave the inserted pencil and is rotated by the torque generated by the torque generation means; the pencil biasing means that converts the rotation of the cutter frame into the motion of biasing the pencil in the insertion direction or ejection direction; the sharpening completion detection means that detects the fully sharpened state of the pencil; and the means that stores energy generated upon the pencil being inserted. Insertion pressure upon the pencil being inserted switches the pencil biasing means to convert the rotation of the cutter frame into the motion of biasing the pencil in the insertion direction, and also switches the pencil basing means to store energy in the means that stores energy, release the energy in conjunction with the sharpening completion detection means, and accordingly convert the rotation of the cutter frame into the motion of biasing the pencil in the ejection direction.

DESCRIPTION OF REFERENCE SIGNS

1 Torque generation means
3 Cutter frame
3*a* Cutter
4 Rotation axis conversion means (pencil biasing means)
4*a*, 4*b* Coaxial gear
4*aa*, 4*bb* Side teeth
4*c* Transmission gear
4*d* Roller-specific gear
5 Feed roller (pencil biasing means)
6 Core tip detection unit (sharpening completion detection means)
6*a* Detection unit elastic means (detection unit biasing means)
6*b* Detection portion
6*c* Transmission portion
7 Slide unit
7*a* Rail guide
8 Slide unit locking means
8*a* Projection lock
8*b* Projection
9 Slide unit elastic means (slide unit ejection means)
10 Slide unit unlocking means
10*a* Cam
10*b* Transmitted portion
11 Rail
100 Shavings storage space
200 Pencil

The invention claimed is:

1. A pencil sharpener for shaving a pencil inserted into the pencil sharpener, comprising:
a casing;
a torque generation means that generates rotational torque by manual rotation of a crank or by an electric motor;
a cutter frame that includes a cutter to shave the inserted pencil and is rotated by torque generated by the torque generation means;
a pencil biasing means that converts the rotation of the cutter frame into motion of biasing the pencil in an insertion direction and biases the pencil in the insertion direction; and
a sharpening completion detection means that detects a fully sharpened state of the pencil, wherein
the pencil biasing means
is capable of translating in the pencil insertion direction and a pencil ejection direction,
stores energy generated by moving the pencil biasing means in the pencil insertion direction upon the pencil being inserted,
releases the energy in conjunction with the sharpening completion detection means, and
accordingly moves the pencil in the pencil ejection direction.

2. The pencil sharpener according to claim 1, further comprising:
a slide unit that is supported by the casing and translates in the pencil insertion and pencil ejection directions;
a slide unit locking means that locks a translation position of the slide unit upon the slide unit translating in the pencil insertion direction; and
a slide unit unlocking means that releases the lock for the translation of the slide unit with the slide unit locking means upon the sharpening completion detection means detecting the fully sharpened state of the pencil, wherein
the slide unit includes a slide unit ejecting means that biases the slide unit in the ejection direction with energy stored by movement of the slide unit to a lock position, and
the pencil biasing means is supported by the slide unit.

3. The pencil sharpener according to claim 1, wherein
the pencil biasing means converts the rotation of the cutter frame into motion of biasing the pencil in the insertion direction and the ejection direction,
upon the pencil biasing means being in a translation position in a case where the pencil is not inserted, the pencil biasing means biases the pencil in the ejection direction, and
upon the pencil being inserted, and the pencil biasing means being in a translation position that has been moved in the pencil insertion direction, the pencil biasing means biases the pencil in the insertion direction.

4. The pencil sharpener according to claim 1, wherein the pencil biasing means is a rotation axis conversion mechanism and a pair of feed rollers.

5. The pencil sharpener according to claim 2, wherein the slide unit ejection means uses elastic force or magnetic force.

6. The pencil sharpener according to claim 2, wherein
the pencil biasing means is a rotation axis conversion mechanism and a pair of feed rollers,
the pencil biasing means includes a rotation axis conversion means,
the rotation axis conversion means includes
two coaxial gears that rotate coaxially with the rotation of the cutter frame,
a transmission gear for causing the two coaxial gears to rotate in synchronization with each other, and
roller-specific gears that are fixed to the feed rollers and rotate about an axis of rotation orthogonal to an axis of rotation of the cutter frame,
one of the two coaxial gears is provided on the pencil insertion side with respect to the feed roller,
the other coaxial gear is provided on the pencil ejection side with respect to the feed roller,
upon the pencil having been inserted, the one of the coaxial gears and the roller-specific gears are coupled and rotated in a position of the slide unit,
upon the sharpening completion detection means having detected the fully sharpened state of the pencil, and the slide unit having moved in the pencil ejection direction, the other coaxial gear and the roller-specific gears are coupled and rotated.

7. A pencil sharpener for shaving a pencil inserted into the pencil sharpener, comprising:

a torque generation means that generates rotational torque by manual rotation of a crank or by an electric motor;

a cutter frame that includes a cutter to shave the inserted pencil and is rotated by torque generated by the torque generation means;

a pencil biasing means that biases the pencil in an insertion direction; and a shaving stop means that stops shaving the pencil in accordance with a fully sharpened state of the pencil, and/or a shaving completion notification means, wherein the cutter frame is provided with a core tip detection unit for detecting a tip position of the pencil, the core tip detection unit rotates in conjunction with the cutter frame, and is supported in such a manner as to be capable of translating or changing an angle with respect to the cutter frame, a detection unit biasing means that biases the core tip detection unit in a pencil ejection direction is provided between the core tip detection unit and the cutter frame, a detection portion being a portion of the core tip detection unit is in a position that comes into contact with a core tip of the pencil, the core tip of the pencil presses the detection portion of the core tip detection unit to cause the core tip detection unit to translate or change the angle with respect to the cutter frame, the translation or angle change allows a rotation path of a transmission portion being a portion of the core tip detection unit to change, and rotational torque of the rotating transmission portion transmits that the pencil has entered a predetermined fully sharpened state to the shaving stop means and/or the shaving completion notification means.

8. The pencil sharpener according to claim 7, wherein the shaving stop means is a mechanism that slides the pencil in the ejection direction.

9. A pencil sharpener for shaving a pencil inserted into the pencil sharpener, comprising:

a casing;

a torque generation means that generates rotational torque by manual rotation of a crank or by an electric motor;

a cutter frame that includes a cutter to shave the inserted pencil and is rotated by torque generated by the torque generation means;

a pencil biasing means that converts the rotation of the cutter frame into motion of biasing the pencil in an insertion direction or an ejection direction;

a sharpening completion detection means that detects a fully sharpened state of the pencil; and a means that stores energy generated upon the pencil being inserted, wherein insertion pressure upon the pencil being inserted switches the pencil biasing means to convert the rotation of the cutter frame into the motion of biasing the pencil in the insertion direction, and also switches the pencil basing means to store energy in the means that stores energy, release the energy in conjunction with the sharpening completion detection means, and accordingly convert the rotation of the cutter frame into the motion of biasing the pencil in the ejection direction.

10. The pencil sharpener according to claim 2, wherein the pencil biasing means converts the rotation of the cutter frame into motion of biasing the pencil in the insertion direction and the ejection direction, upon the pencil biasing means being in a translation position in a case where the pencil is not inserted, the pencil biasing means biases the pencil in the ejection direction, and upon the pencil being inserted, and the pencil biasing means being in a translation position that has been moved in the pencil insertion direction, the pencil biasing means biases the pencil in the insertion direction.

11. The pencil sharpener according to claim 2, wherein the pencil biasing means is a rotation axis conversion mechanism and a pair of feed rollers.

12. The pencil sharpener according to claim 3, wherein the pencil biasing means is a rotation axis conversion mechanism and a pair of feed rollers.

* * * * *